US012589852B2

(12) United States Patent
Miyaki

(10) Patent No.: US 12,589,852 B2
(45) Date of Patent: Mar. 31, 2026

(54) SHIP STEERING CONTROL DEVICE

(71) Applicant: SUZUKI MOTOR CORPORATION, Hamamatsu (JP)

(72) Inventor: Tomohiko Miyaki, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 91 days.

(21) Appl. No.: 18/632,808

(22) Filed: Apr. 11, 2024

(65) Prior Publication Data

US 2024/0400185 A1 Dec. 5, 2024

(30) Foreign Application Priority Data

May 29, 2023 (JP) ..... 2023-087834

(51) Int. Cl.

*B63H 25/42* (2006.01)
*B63H 21/21* (2006.01)
*B63H 25/04* (2006.01)
*B63H 25/02* (2006.01)

(52) U.S. Cl.

CPC ..... *B63H 25/42* (2013.01); *B63H 25/04* (2013.01); *B63H 21/213* (2013.01); *B63H 2025/022* (2013.01); *B63H 2025/026* (2013.01)

(58) Field of Classification Search

CPC ..... B63H 25/42; B63H 25/04; B63H 21/213; B63H 2025/022; B63H 2025/026

USPC ..... 701/21

See application file for complete search history.

(56) References Cited

U.S. PATENT DOCUMENTS 5,050,518 A * 9/1991 Okita ..... G05D 1/0061 114/144 RE
5,235,927 A * 8/1993 Singh ..... G05D 1/0061 318/588
5,523,951 A * 6/1996 Kriesgman ..... G01C 21/203 701/472
5,711,742 A * 1/1998 Leinonen ..... B63H 23/06 477/121
6,978,729 B2 * 12/2005 Bertetti ..... G01S 15/93 114/151
9,290,254 B2 * 3/2016 Kern ..... B63H 21/213
10,501,116 B2 * 12/2019 Mizoguchi ..... B62D 1/286
11,597,434 B2 * 3/2023 Yamashita ..... B62D 5/006
2005/0229833 A1 * 10/2005 McKenney ..... B63H 25/04 114/144 R
2014/0338580 A1 * 11/2014 Maynard ..... B63H 25/04 114/144 R (Continued)

FOREIGN PATENT DOCUMENTS

JP 3201225 U 11/2015

*Primary Examiner* — Manglesh M Patel
(74) *Attorney, Agent, or Firm* — Stein IP, LLC

(57) ABSTRACT

A ship steering control device for controlling steering of a ship. The ship includes a ship propulsion device configured to generate a propulsion force of the ship and a manual operation unit for manually operating the ship propulsion device. The ship steering control device includes a manual steering controller, an automatic steering controller, an abnormality detection unit, and a steering mode switching unit. The manual steering controller is configured to control. The steering mode switching unit includes an automatic steering cancellation unit, a propulsion force gradual reduction controller, an operation position determination unit, and a manual steering start unit.

7 Claims, 9 Drawing Sheets

(56) References Cited

U.S. PATENT DOCUMENTS

| | | | | |
|---|---|---|---|---|
| 2019/0106189 | A1* | 4/2019 | Tamura | B63H 21/21 |
| 2021/0294329 | A1* | 9/2021 | Afman | G08G 3/00 |
| 2023/0161360 | A1* | 5/2023 | Inoue | G05D 1/0206 701/21 |
| 2024/0425168 | A1* | 12/2024 | Ito | B63H 25/04 |
| 2025/0263161 | A1* | 8/2025 | Inoue | B63H 25/04 |

* cited by examiner (FIG. 5 CONTINUED)
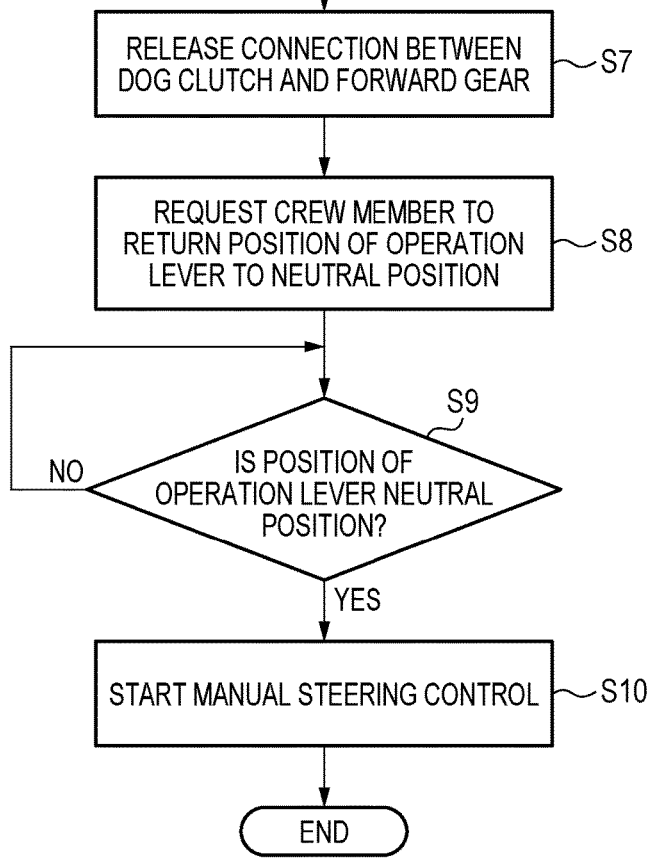

SHIP STEERING CONTROL DEVICE

CROSS-REFERENCE TO RELATED APPLICATIONS

This application is based on and claims priority under 35 USC 119 from Japanese Patent Application No. 2023-087834 filed on May 29, 2023, the entire content of which is incorporated herein by reference.

TECHNICAL FIELD

The present disclosure relates to a ship steering control device for controlling steering of a ship.

BACKGROUND ART

A ship is provided with a ship propulsion device configured to propel the ship and a propulsion operation device configured to operate the ship propulsion device. The ship propulsion device includes an outboard motor, an inboard-outdrive motor, and an inboard motor. The propulsion operation device includes a remote control device (hereinafter, referred to as a "remote control device") for remotely operating the ship propulsion device. According to the remote control device, a crew member can operate the ship propulsion device from a location away from the ship propulsion device, on the ship.

The remote control device includes an operation lever. The crew member can move the ship forward or in reverse by tilting the operation lever in a front-rear direction. Specifically, in a case where a position of the operation lever is a neutral position, the ship propulsion device sets a propulsion force of the ship to zero. In a general remote control device, a state where the operation lever is raised vertically is a state where the operation lever is in the neutral position. In a case where the operation lever is tilted forward with respect to a vertical direction, the propulsion force that pushes the ship forward is generated by the ship propulsion device. Thus, the ship moves forward. As a forward inclination angle of the operation lever with respect to the vertical direction increases, a propulsion force generated by the ship propulsion device increases. As a result, a forward speed of the ship increases. In a case where the operation lever is tilted rearward with respect to the vertical direction, a propulsion force that pushes the ship rearward is generated by the ship propulsion device. Thus, the ship moves in reverse. As a rearward inclination angle of the operation lever with respect to the vertical direction increases, the propulsion force generated by the ship propulsion device increases. As a result, a reverse speed of the ship increases.

In addition, the ship is provided with a steering device configured to change a traveling direction of the ship and a steering operation device configured to operate the steering device. In a case where the ship propulsion device is an outboard motor, the steering device is an actuator configured to changes a horizontal orientation of the outboard motor with respect to the ship. In a case where the ship propulsion device is an inboard-outdrive motor, the steering device is an actuator configured to change a horizontal orientation of a drive system part of the inboard-outdrive motor, in which a propeller is provided, with respect to the ship. In a case where the ship propulsion device is an inboard motor, the steering device is an actuator configured to move a rudder. The steering operation device is, for example, a handle.

Although both the remote control device and the handle described above are operation devices for the crew member to manually steer the ship, an automatic steering device for automatically steering a ship is currently widely used. The automatic steering device has a function of recognizing the current position of the ship based on a global positioning system (GPS), nautical chart data, and the like. In addition, the automatic steering device has a function of automatically navigating the ship along a route set by the crew member.

To start automatic steering of the ship by the automatic steering device, the crew member first sets a route from the current position of the ship to a destination and inputs an instruction to start the automatic steering. Next, the crew member tilts the operation lever of the remote control device forward with respect to the vertical direction, and adjusts the inclination angle of the operation lever such that the forward speed of the ship becomes a desired speed. The automatic steering device starts the automatic steering, in a case where the forward speed of the ship is stabilized. During the automatic steering, in a case where a navigation state of the ship and the situation around the ship are safe and in a case where the ship or the devices provided on the ship are operating normally, the crew member basically does not need to operate the remote control device or the handle.

The automatic steering device is configured to control the steering device during the automatic steering, and configured to perform automatic steering of the ship such that the ship travels on the set route. In addition, some automatic steering devices have a function of controlling the ship propulsion device and of automatically maintaining a constant speed of the ship traveling straight on the set route, during the automatic steering. Further, some automatic steering devices have a function of automatically increasing or decreasing the speed of the ship by controlling the ship propulsion device, in order to suppress overshoot during turning of the ship, in a case where the ship is automatically turned at a course changing position on the set route, during the automatic steering. For example, in order to suppress overshoot during turning of the ship, the automatic steering device is configured to automatically decrease the speed of the ship immediately before turning and during turning, and is configured to increase the speed of the ship return the speed of the ship to the speed during straight traveling after turning.

JP3201225U describes a technique of guiding and controlling a ship to a preset course, based on current position information, guidance route information, and stop and hold position information of the ship according to a GPS compass and an electronic nautical chart system.

In a case where an abnormality occurs in an operation of the automatic steering device during automatic steering, a steering mode of the ship is switched from the automatic steering to manual steering in order to ensure the safety of crew members. Regarding the switching of the steering mode, there are the following situation.

In a case where the crew member operates the operation lever of the remote control device after the steering mode of the ship is switched from the automatic steering to the manual steering, the speed of the ship may suddenly change against the intention of the crew member, and the crew member may feel uncomfortable that the operation of the operation lever does not match the movement of the ship.

Such a sudden change in the speed of the ship and the uncomfortable feeling of the crew member are caused by a deviation between the inclination angle of the operation lever of the remote control device and the propulsion force generated by the ship propulsion device at the time when the steering mode of the ship is switched from the automatic steering to the manual steering. The reason for this deviation is as follows.

As described above, to start the automatic steering, the crew member tilts the operation lever of the remote control device forward with respect to the vertical direction, and adjusts the inclination angle of the operation lever such that the forward speed of the ship becomes a desired speed. In addition, in a case where the automatic steering device has the function of automatically maintaining a constant speed of the ship that travels straight forward during the automatic steering, the automatic steering device controls the ship propulsion device during the automatic steering, and changes the propulsion force generated by the ship propulsion device so as to cancel out changes in the speed of the ship due to the influence of water currents, wind, or the like. In a case where the automatic steering device has the function of automatically increasing or decreasing the speed of the ship in order to suppress overshoot during turning of the ship, the automatic steering device controls the ship propulsion device to change the propulsion force generated by the ship propulsion device when the ship is turned during the automatic steering. In this way, in a case where the automatic steering device changes the propulsion force generated by the ship propulsion device during the automatic steering and the crew member tilts the operation lever of the remote control device forward to adjust the inclination angle of the operation lever at the start of the automatic steering, but does not operate the operation lever at all during the automatic steering, the inclination angle of the operation lever and the propulsion force generated by the ship propulsion device may not match, that is, a deviation may occur therebetween. In a case where there is a deviation between the inclination angle of the operation lever and the propulsion force generated by the ship propulsion device during the automatic steering, an abnormality in the operation of the automatic steering device is recognized, and when the steering mode of the ship is switched from the automatic steering to the manual steering, the deviation occurs between the inclination angle of the operation lever of the remote control device and the propulsion force generated by the ship propulsion device when the steering mode of the ship is switched from the automatic steering to the manual steering.

After the steering mode of the ship is switched from the automatic steering to the manual steering, in a case where the crew member operates the operation lever in a state where there is a large deviation between the inclination angle of the operation lever of the remote control device and the propulsion force generated by the ship propulsion device, the speed of the ship suddenly changes against the intention of the crew member. Specifically, the speed of the ship suddenly changes even though the crew member slowly and gradually operates the operation lever to gradually increase or decrease the speed of the ship. For example, after the steering mode of the ship is switched from the automatic steering to the manual steering, in a state where the propulsion force actually generated by the ship propulsion device when an actual inclination angle of the operation lever is 45 degrees forward with respect to the vertical direction is equal to the propulsion force generated when the inclination angle of the operation lever is 60 degrees forward with respect to the vertical direction by manual operation, if the crew member inclines the operation lever rearward by 5 degrees by the manual operation, that operation is the same as an operation in which the forward inclination angle of the operation lever with respect to the vertical direction is instantaneously changed from 60 degrees to 40 degrees. As a result, the speed of the ship suddenly decreases. The sudden change in the speed of the ship may cause a large change in the movement of the ship and should be avoided.

In addition, after the steering mode of the ship is switched from the automatic steering to the manual steering, if the crew member operates the operation lever in a state where there is a large deviation between the inclination angle of the operation lever of the remote control device and the propulsion force generated by the ship propulsion device, the crew member may feel uncomfortable that the operation of the operation lever does not match the movement of the ship. For example, after the steering mode of the ship is switched from the automatic steering to the manual steering, in a state in which the propulsion force actually generated by the ship propulsion device when an actual inclination angle of the operation lever is 45 degrees forward with respect to the vertical direction is equal to the propulsion force generated when the inclination angle of the operation lever is 30 degrees forward with respect to the vertical direction by manual operation, if the crew member inclines the operation lever rearward by 5 degrees by the manual operation, that operation is the same as an operation in which the forward inclination angle of the operation lever with respect to the vertical direction is instantaneously changed from 30 degrees to 40 degrees. As a result, the speed of the ship increases. The crew member feels uncomfortable since the speed of the ship increases even though the crew member operates the operation lever in a direction in which the speed of the ship decreases. It is necessary to prevent the crew member from feeling uncomfortable since such uncomfortable feeling confuses the crew member.

SUMMARY OF INVENTION

Aspect of non-limiting embodiments of the present disclosure relates to provide a ship steering control device capable of preventing a sudden change in a speed of a ship when a crew member operates a manual operation unit (for example, an operation lever of a remote control device) after a steering mode of the ship is switched from automatic steering to manual steering due to an abnormality in an automatic steering operation during the automatic steering of the ship, and capable of preventing the crew member from feeling uncomfortable that the operation of the manual operation unit does not match the movement of the ship.

Aspects of certain non-limiting embodiments of the present disclosure address the features discussed above and/or other features not described above. However, aspects of the non-limiting embodiments are not required to address the above features, and aspects of the non-limiting embodiments of the present disclosure may not address features described above.

According to an aspect of the present disclosure, there is provided a ship steering control device for controlling steering of a ship, the ship including a ship propulsion device configured to generate a propulsion force of the ship and a manual operation unit for manually operating the ship propulsion device, the ship steering control device including:

- a manual steering controller configured to control the ship propulsion device, according to a manual operation with respect to the manual operation unit;
- an automatic steering controller configured to automatically control the ship propulsion device, without receiving the manual operation with respect to the manual operation unit;

an abnormality detection unit configured to detect an abnormality in behavior of the automatic steering controller; and a steering mode switching unit configured to switch control of the ship propulsion device from control by the automatic steering controller to control by the manual steering controller, in a case where the abnormality is detected by the abnormality detection unit when the ship propulsion device is controlled by the automatic steering controller, in which the manual steering controller is configured to control:

the ship propulsion device such that a propulsion force of the ship becomes zero, in a case where a position of the manual operation unit is a neutral position;

the ship propulsion device such that a propulsion force that pushes the ship forward is generated, in a case where the position of the manual operation unit is moved in one direction from the neutral position; and the ship propulsion device such that the propulsion force that pushes the ship forward increases as a movement amount of the position of the manual operation unit in the one direction from the neutral position increases, and the steering mode switching unit includes:

an automatic steering cancellation unit configured to cancel the control of the ship propulsion device by the automatic steering controller, in a case where the abnormality is detected by the abnormality detection unit;

a propulsion force gradual reduction controller configured to control the ship propulsion device to gradually reduce the propulsion force of the ship until the propulsion force of the ship becomes zero, after the automatic steering cancellation unit cancels the control of the ship propulsion device by the automatic steering controller;

an operation position determination unit configured to determine whether the position of the manual operation unit is the neutral position, after the propulsion force of the ship becomes zero under the control of the ship propulsion device by the propulsion force gradual reduction controller; and a manual steering start unit configured to:

maintain the propulsion force of the ship at zero, after the propulsion force of the ship becomes zero under the control of the ship propulsion device by the propulsion force gradual reduction controller until the operation position determination unit determines that the position of the manual operation unit is the neutral position; and start the control of the ship propulsion device by the manual steering controller, after the operation position determination unit determines that the position of the manual operation unit is the neutral position.

According to an aspect of the present disclosure, there is provided a ship steering control device for controlling steering of a ship, the ship including a ship propulsion device configured to generate a propulsion force of the ship and a manual operation unit for manually operating the ship propulsion device, the ship steering control device including: a manual steering controller configured to control the ship propulsion device, according to a manual operation with respect to the manual operation unit; an automatic steering controller configured to automatically control the ship propulsion device, without receiving the manual operation with respect to the manual operation unit; and a controller configured to:

detect an abnormality in behavior of the automatic steering controller; and switch control of the ship propulsion device from control by the automatic steering controller to control by the manual steering controller, in a case where the abnormality is detected by the controller when the ship propulsion device is controlled by the automatic steering controller, in which the manual steering controller is configured to control:

the ship propulsion device such that a propulsion force of the ship becomes zero, in a case where a position of the manual operation unit is a neutral position;

the ship propulsion device such that a propulsion force that pushes the ship forward is generated, in a case where the position of the manual operation unit is moved in one direction from the neutral position; and the ship propulsion device such that the propulsion force that pushes the ship forward increases as a movement amount of the position of the manual operation unit in the one direction from the neutral position increases, and the controller is further configured to:

cancel the control of the ship propulsion device by the automatic steering controller, in a case where the abnormality is detected by the controller;

control the ship propulsion device to gradually reduce the propulsion force of the ship until the propulsion force of the ship becomes zero, after the controller cancels the control of the ship propulsion device by the automatic steering controller;

determine whether the position of the manual operation unit is the neutral position, after the propulsion force of the ship becomes zero under the control of the ship propulsion device by the propulsion force gradual reduction controller; and maintain the propulsion force of the ship at zero, after the propulsion force of the ship becomes zero under the control of the ship propulsion device by the propulsion force gradual reduction controller until the controller determines that the position of the manual operation unit is the neutral position; and start the control of the ship propulsion device by the manual steering controller, after the controller determines that the position of the manual operation unit is the neutral position.

BRIEF DESCRIPTION OF DRAWINGS

Exemplary embodiment(s) of the present invention will be described in detail based on the following figures, wherein.

DESCRIPTION OF EMBODIMENTS

Figure 1:
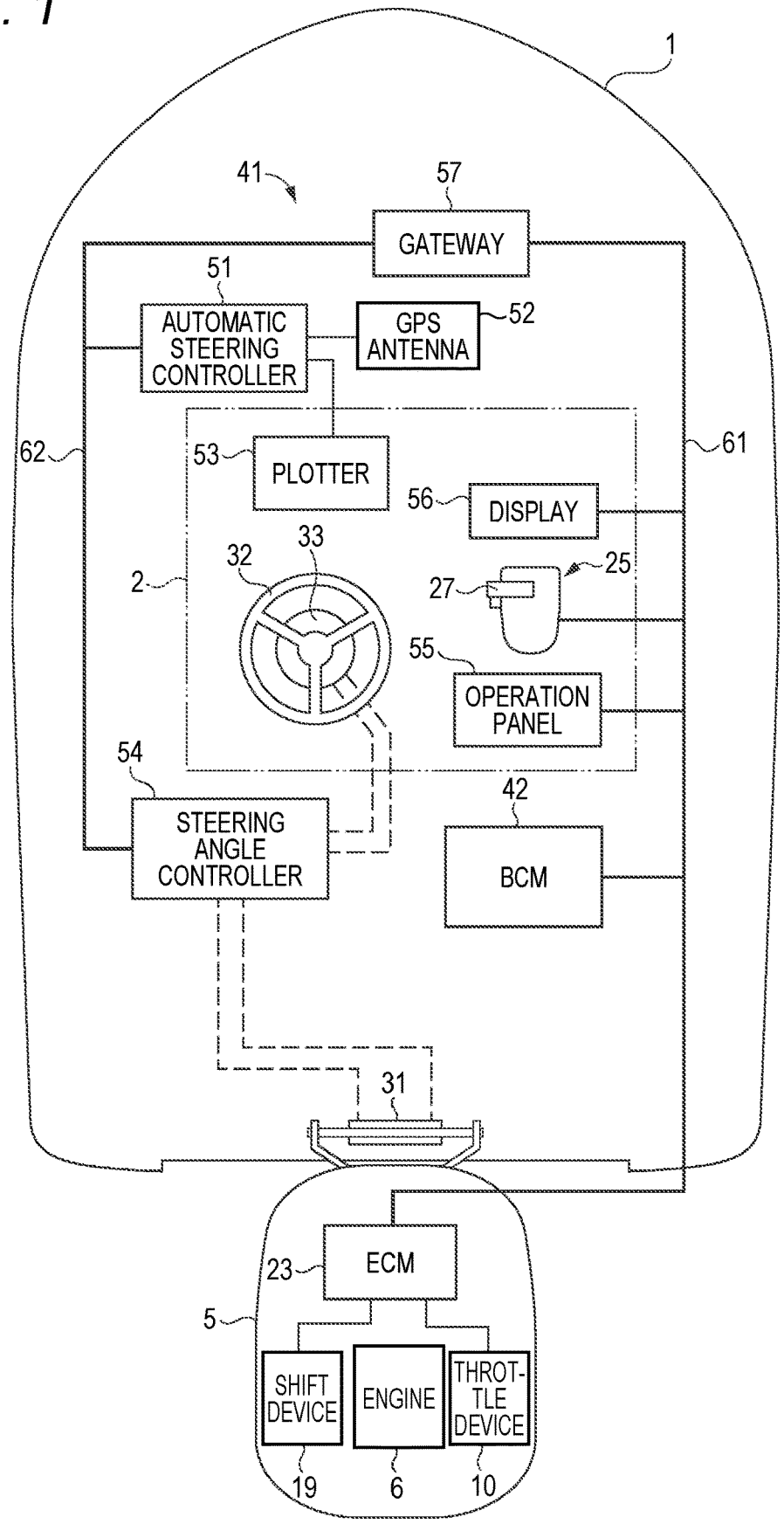
FIG. 1 is an explanatory diagram illustrating a ship provided with a ship steering control device according to a first exemplary embodiment of the present invention.

A ship steering control device according to an embodiment of the present disclosure is a device configured to control steering of a ship. A ship to which the ship steering control device is applied is provided with a ship propulsion device configured to generate a propulsion force of the ship and a manual operation unit for manually operating the ship propulsion device.

The ship steering control device of the present embodiment includes a manual steering controller, an automatic steering controller, an abnormality detection unit, and a steering mode switching unit.

The manual steering controller is configured to control the ship propulsion device, according to a manual operation of the manual operation unit. Specifically, the manual steering controller is configured to control the ship propulsion device such that a propulsion force of the ship becomes zero, in a case where a position of the manual operation unit is a neutral position. That is, the ship propulsion device no longer generates the propulsion force, in a case where a position of the manual operation unit is a neutral position. The manual steering controller is configured to control the ship propulsion device such that the propulsion force that pushes the ship forward is generated, in a case where the position of the manual operation unit is moved in one direction from the neutral position. In addition, the manual steering controller is configured to control the ship propulsion device such that the propulsion force that pushes the ship forward increases as a movement amount of the position of the manual operation unit in the one direction from the neutral position increases.

The automatic steering controller is configured to automatically control the ship propulsion device, without receiving the manual operation of the manual operation unit. For example, in order to make the ship to travel straight at a constant speed, the automatic steering controller is configured to control the ship propulsion device to change the propulsion force of the ship so as to cancel out changes in a speed of the ship due to the influence of water currents, wind, or the like. In addition, in order to smoothly turn the ship while suppressing overshoot during turning of the ship, the automatic steering controller is configured to control the ship propulsion device to change the propulsion force of the ship.

The abnormality detection unit is configured to detect an abnormality in an operation of the automatic steering controller. In a case where at least one of an abnormality in the automatic steering controller, an abnormality in the ship propulsion device, or an abnormality in the communication between the automatic steering controller and the ship propulsion device occurs, the operation of the automatic steering controller is abnormal. The abnormality detection unit is configured to detect, as the abnormality in the operation of the automatic steering controller, at least one of the abnormality in the automatic steering controller, the abnormality in the ship propulsion device, or the abnormality in the communication between the automatic steering controller and the ship propulsion device.

In a case where the abnormality detection unit detects an abnormality in the operation of the automatic steering controller when the ship propulsion device is controlled by the automatic steering controller, the steering mode switching unit switches the control of the ship propulsion device from the control by the automatic steering controller to the control by the manual steering controller.

The steering mode switching unit includes an automatic steering cancellation unit, a propulsion force gradual reduction controller, an operation position determination unit, and a manual steering start unit.

The automatic steering cancellation unit is configured to cancel the control of the ship propulsion device by the automatic steering controller, in a case where the abnormality detection unit detects an abnormality in the operation of the automatic steering controller.

After the automatic steering cancellation unit cancels the control of the ship propulsion device by the automatic steering controller, the propulsion force gradual reduction controller gradually reduces the propulsion force of the ship by controlling the ship propulsion device until the propulsion force of the ship becomes zero.

The operation position determination unit determines whether the position of the manual operation unit is the neutral position, after the propulsion force of the ship becomes zero under the control of the ship propulsion device by the propulsion force gradual reduction controller.

After the propulsion force of the ship becomes zero under the control of the ship propulsion device by the propulsion force gradual reduction controller, the manual steering start unit maintains the propulsion force of the ship at zero until the operation position determination unit determines that the position of the manual operation unit is the neutral position, and starts the control of the ship propulsion device by the manual steering controller after the operation position determination unit determines that the position of the manual operation unit is the neutral position.

In a case where an abnormality in the operation of the automatic steering controller is detected, the ship steering control device according to the present embodiment first cancels the control of the ship propulsion device by the automatic steering controller, and then gradually reduces the propulsion force of the ship until the propulsion force of the ship becomes zero. Thereafter, the ship steering control device maintains the propulsion force of the ship at zero until it is determined that the position of the manual operation unit is the neutral position. That is, the ship steering control device waits while maintaining the propulsion force of the ship at zero, until a crew member moves the manual operation unit to the neutral position. In an actual operation, for example, immediately after the propulsion force of the ship is gradually reduced until the propulsion force of the ship becomes zero, an instruction to return the manual operation unit to the neutral position may be provided to the crew member. For example, it is preferable to display such an instruction on a display device provided in a cockpit of the ship. Then, in a case where the crew member moves the manual operation unit to the neutral position, the ship steering control device determines that the position of the manual operation unit is the neutral position and starts control of the ship propulsion device by the manual steering controller.

According to such processing of the automatic steering control device, in a case where the operation of the automatic steering controller is abnormal, the propulsion force generated by the ship propulsion device is zero and the position of the manual operation unit is the neutral position immediately before the control of the ship propulsion device by the manual steering controller is started. That is, immediately before the control of the ship propulsion device by the manual steering controller is started when the operation of the automatic steering controller is abnormal, the position of the manual operation unit matches the propulsion force (=zero) generated by the ship propulsion device. Therefore, in a case where the crew member operates the manual operation unit to start manual steering of the ship, it is possible to prevent the speed of the ship from suddenly changing against the intention of the crew member, and it is possible to prevent the crew member from feeling uncomfortable that the operation of the manual operation unit and the movement of the ship do not match.

First Embodiment (Ship and Ship Steering Control Device)

Figure 2:
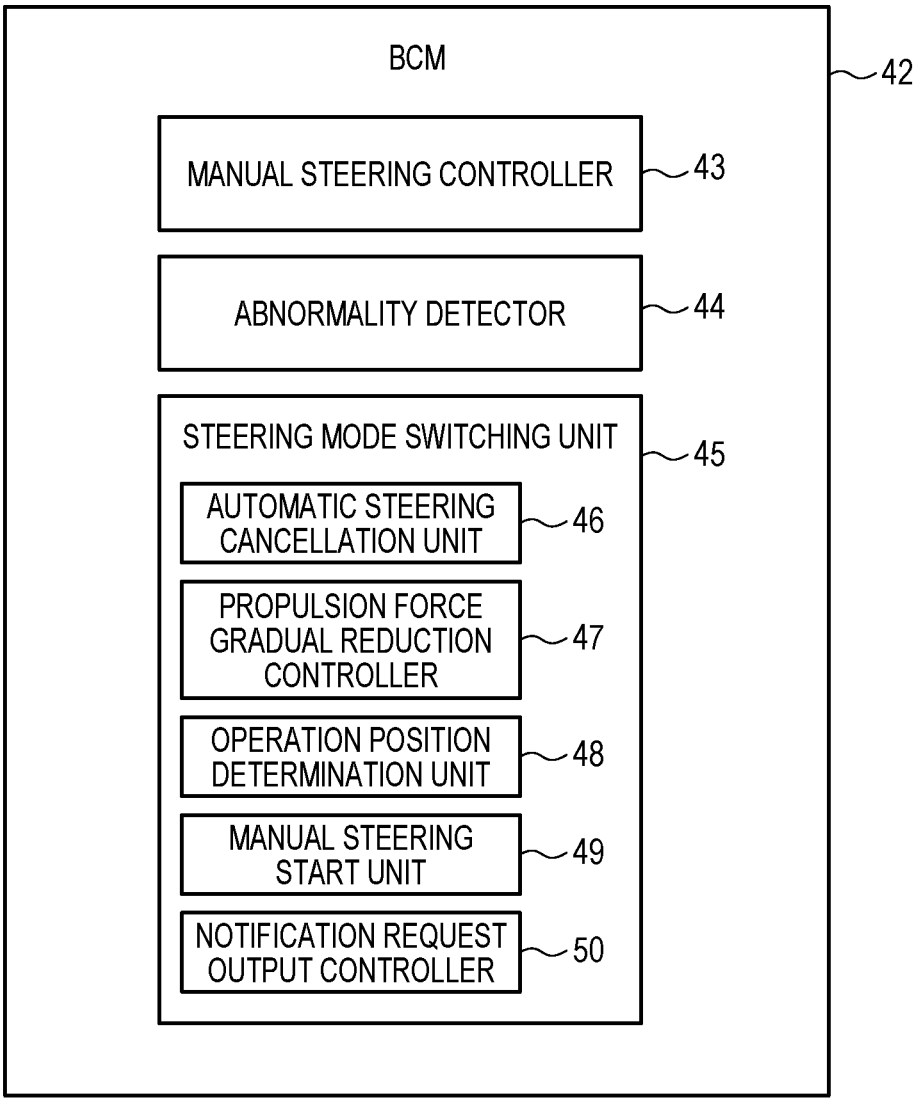
FIG. 2 is an explanatory diagram illustrating a boat control module (BCM) provided in the ship in FIG. 1.

FIG. 1 shows a ship 1 provided with a ship steering control device 41 according to a first embodiment of the present disclosure. FIG. 2 shows a boat control module (BCM) 42 provided in the ship 1.

In FIG. 1, the ship 1 is, for example, a small ship such as a boat or a medium-sized ship. The ship 1 is provided with an outboard motor 5, a remote control device 25, a hydraulic steering actuator 31, a handle 32, a helm pump 33, and a ship steering control device 41.

The outboard motor 5 is a ship propulsion device configured to propel the ship 1 and configured to generate a propulsion force of the ship 1. The outboard motor 5 is attached to a center in a left-right direction of a stern of a hull of the ship 1, and is disposed outside the hull. The remote control device 25 is a device configured to remotely operate the outboard motor 5, and is a device for a crew member to manually operate the outboard motor 5. The remote control device 25 is disposed in a cockpit 2 of the ship 1.

The hydraulic steering actuator 31 is a device configured to change a horizontal orientation of the outboard motor 5 with respect to the ship 1 to change a traveling direction of the ship 1. The handle 32 is a device for the crew member to manually operate the hydraulic steering actuator 31. The handle 32 is disposed in the cockpit 2 of the ship 1. The helm pump 33 is a hydraulic pump for controlling the hydraulic steering actuator 31 according to the operation of the handle 32 using a hydraulic pressure.

The ship steering control device 41 is a device configured to control the steering of the ship 1. The ship steering control device 41 has a function related to manual steering of the ship 1 and a function related to automatic steering of the ship 1. The ship steering control device 41 has a function of controlling the outboard motor 5 according to the operation of the remote control device 25, as the function related to the manual steering of the ship 1. The ship steering control device 41 has a function of automatically changing the traveling direction of the ship 1 without the operation of the handle 32 and automatically changing the propulsion force of the ship 1 without the operation of the remote control device 25 such that the ship 1 smoothly sails on a set route, as the function related to the automatic steering of the ship 1. Further, the ship steering control device 41 has a function of switching a steering mode of the ship 1 from the automatic steering to the manual steering in a case where an abnormality occurs in an automatic steering operation during the automatic steering of the ship 1.

The ship steering control device 41 includes the BCM 42, an automatic steering controller 51, a GPS antenna 52, a plotter 53, a steering angle controller 54, an operation panel 55, a display 56, and a gateway 57.

The BCM 42 is a device for performing comprehensive control of the ship 1, control for establishing cooperation between a plurality of devices provided in the ship 1, and the like. The BCM 42 includes an arithmetic processing device and a storage device. As shown in FIG. 2, the BCM 42 includes a manual steering controller 43, an abnormality detection unit 44, and a steering mode switching unit 45. The manual steering controller 43 is configured to control the outboard motor 5, according to the operation of the remote control device 25. The abnormality detection unit 44 is configured to detect an abnormality in the automatic steering operation by the automatic steering controller 51. In a case where an abnormality occurs in the automatic steering operation during the automatic steering of the ship 1, the steering mode switching unit 45 switches the steering mode of the ship 1 from the automatic steering to the manual steering. The BCM 42 has an automatic steering support function of controlling the outboard motor 5, based on a command signal transmitted from the automatic steering controller 51. The manual steering controller 43, the abnormality detection unit 44, the steering mode switching unit 45, and the automatic steering support function are implemented by, for example, the arithmetic processing device of the BCM 42 reading and executing programs stored in the storage device of the BCM 42. The BCM 42 may function as the manual steering controller 43, the abnormality detection unit 44, and the steering mode switching unit 45, and the like.

The automatic steering controller 51 is a device for performing the automatic steering of the ship 1. The automatic steering controller 51 includes an arithmetic processing device and a storage device. During the automatic steering, the automatic steering controller 51 is configured to control the hydraulic steering actuator 31 via the steering angle controller 54, and is configured to automatically change the traveling direction of the ship 1 without the operation of the handle 32 such that the ship 1 sails on the route set by the crew member. In addition, during the automatic steering, the automatic steering controller 51 is configured to control the outboard motor 5 via the BCM 42, and is configured to automatically change the propulsion force of the ship 1 without the operation of an operation lever 27 of the remote control device 25 such that the ship 1 smoothly sails on the route set by the crew member. Specifically, the automatic steering controller 51 is configured to transmit a command signal for controlling the outboard motor 5 to the BCM 42, and the BCM 42 is configured to control the outboard motor 5 based on the command signal. The automatic steering controller 51 is a specific example of the "automatic steering controller".

The GPS antenna 52 is an antenna configured to receive radio waves from GPS satellites. The GPS antenna 52 is configured to output, to the automatic steering controller 51, information transmitted from GPS satellites via radio waves.

The plotter 53 includes, for example, a liquid crystal display and a touch panel. The crew member can set a route for automatically steering the ship 1 and input an instruction to start the automatic steering using the plotter 53. The plotter 53 is configured to output, to the automatic steering controller 51, route information indicating the route set by the crew member and a signal indicating the instruction to start the automatic steering. The plotter 53 is disposed in the cockpit 2 of the ship 1.

The steering angle controller 54 is a device configured to control the hydraulic steering actuator 31, based on an electric signal (steering control signal) output from the automatic steering controller 51, during the automatic steering. The steering angle controller 54 has a built-in automatic steering hydraulic pump configured to operate according to a steering control signal output from the automatic steering controller 51. The steering angle controller 54 is configured to control the hydraulic steering actuator 31, using a hydraulic pressure generated by the automatic steering hydraulic pump.

The operation panel 55 is a device mainly for starting and stopping the outboard motor 5, and is provided with buttons and the like for starting and stopping an engine 6 of the outboard motor 5. The operation panel 55 is disposed in the cockpit 2 of the ship 1.

The display 56 includes, for example, a liquid crystal display. The display 56 is configured to display information related to the outboard motor 5 (for example, an engine rotation speed, a remaining fuel amount, and the like), information related to the ship (for example, the speed of the ship), various notifications, and the like. The display 56 is disposed in the cockpit 2 of the ship 1.

An engine control module (ECM) 23, the remote control device 25, the BCM 42, the operation panel 55, and the display 56 of the outboard motor 5 are electrically connected to one another via a first network 61, and communicate with one another according to a serial communication protocol such as a control area network (CAN). The automatic steering controller 51 and the steering angle controller 54 are electrically connected via a second network 62, and communicate with each other according to the serial communication protocol such as CAN. The gateway 57 is a device for electrically connecting the first network 61 and the second network 62. The two networks 61 and 62 are constructed in the ship 1 due to design circumstances. Depending on a design manner, the networks in the ship 1 can be integrated into one, and in this case, the gateway 57 is unnecessary.

(Outboard Motor)

Figure 3:
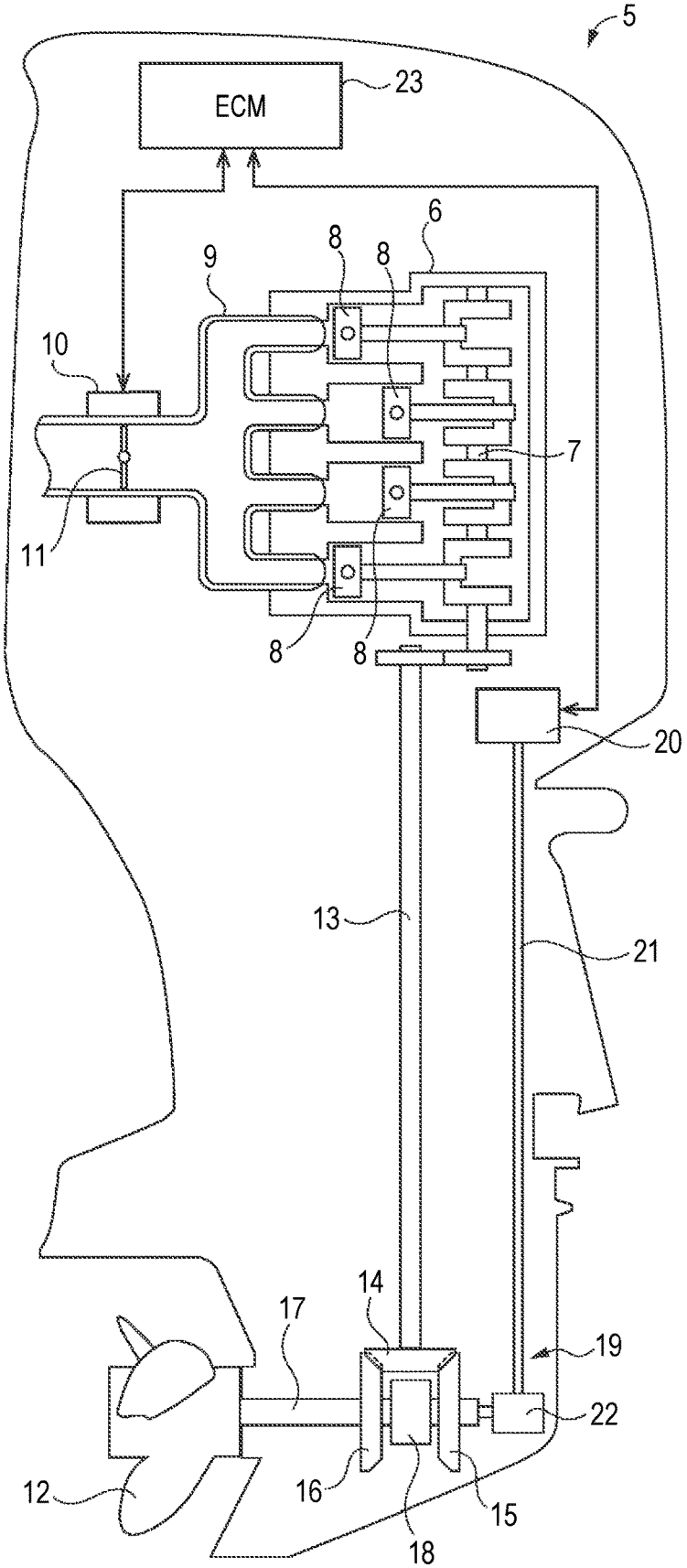
FIG. 3 is an explanatory diagram illustrating an outboard motor provided in the ship in FIG. 1.

FIG. 3 schematically shows an internal structure of the outboard motor 5. In FIG. 3, the outboard motor 5 includes the engine 6, a throttle device 10, a propeller 12, a shift device 19, and the ECM 23.

The engine 6 is a power source configured to generate the propulsion force, and includes a crankshaft 7 and pistons 8. The engine 6 is disposed in an upper portion of the outboard motor 5, the upper portion being positioned above the water surface.

The throttle device 10 is a device configured to adjust an inflow amount of the combustion air into a combustion chamber of the engine 6 by opening and closing a throttle valve 11. The throttle device 10 of the present embodiment is an electronically controlled throttle device. An intake manifold 9 for allowing the combustion air to flow into the combustion chamber of the engine 6 is connected to the engine 6, and the throttle device 10 is attached to the intake manifold 9. The throttle valve 11 is disposed in an inflow pipe of the intake manifold 9. In a case where an opening degree of the throttle valve 11 is an idling opening degree, a rotation speed of the engine 6 is an idling rotation speed. In the present embodiment, a state where the throttle valve 11 is fully closed is a state where the opening degree of the throttle valve 11 is the idling opening degree. The supply of the combustion air into the combustion chamber for maintaining the rotation speed of the engine 6 at the idling rotation speed is performed via, for example, another air passage for idling driving. As the opening degree of the throttle valve 11 increases, the rotation speed of the engine 6 increases. As the rotation speed of the engine 6 increases, a rotation speed of the propeller 12 increases. Thus, the propulsion force generated by the outboard motor 5 increases, and the propulsion force of the ship 1 increases.

The propeller 12 is a device configured to convert power of the engine 6 into the propulsion force of the ship 1, and is disposed in a rear portion of a lower portion of the outboard motor 5, the lower portion being positioned below the water surface.

A drive shaft 13, a drive gear 14, a forward gear 15, a reverse gear 16, a propeller shaft 17, and a dog clutch 18 are provided between the engine 6 and the propeller 12, as a mechanism for transmitting the power of the engine 6 to the propeller 12. The drive shaft 13 extends vertically from the upper portion to the lower portion of the outboard motor 5, and the drive gear 14 is fixed to a lower end portion of the drive shaft 13. The drive shaft 13 is configured to rotate by receiving the power of the engine 6, and the drive gear 14 is configured to rotate accordingly. The drive gear 14, the forward gear 15, and the reverse gear 16 are all bevel gears. The drive gear 14 is disposed such that a rotation axis thereof is vertical, whereas the forward gear 15 and the reverse gear 16 are disposed such that rotation axes thereof are horizontal. The forward gear 15 and the reverse gear 16 are coaxially disposed so as to face each other. The forward gear 15 meshes with the drive gear 14 at a position in front of the drive shaft 13. The reverse gear 16 meshes with the drive gear 14 at a position behind the drive shaft 13. Therefore, as the drive gear 14 rotates, the forward gear 15 and the reverse gear 16 rotate in opposite directions. The propeller shaft 17 is disposed at the lower portion of the outboard motor 5 and extends horizontally, and the propeller 12 is fixed to a rear end portion of the propeller shaft 17. A front end portion of the propeller shaft 17 is inserted in a non-contact state into through holes provided at centers of the forward gear 15 and the reverse gear 16, and neither the forward gear 15 nor the reverse gear 16 is fixed to the propeller shaft 17. The dog clutch 18 is disposed between the forward gear 15 and the reverse gear 16. The dog clutch 18 is attached to the front end portion of the propeller shaft 17 so as to be immovable in a peripheral direction, and so as to be movable in an axial direction with respect to the propeller shaft 17. Teeth are formed on a front surface and a rear surface of the dog clutch 18, teeth are formed on an inner peripheral side portion of a rear surface of the forward gear 15, and teeth are also formed on an inner peripheral side portion of a front surface of the reverse gear 16. In a case where the dog clutch 18 is moved forward under the control of the shift device 19, the teeth formed on the front surface of the dog clutch 18 mesh with the teeth formed on the rear surface of the forward gear 15, and the dog clutch 18 and the forward gear 15 are connected to each other. Thus, the rotation of the drive shaft 13 is transmitted to the propeller shaft 17 via the forward gear 15, and the propeller shaft 17 and the propeller 12 rotate forward. A propulsion force that pushes the ship 1 forward is generated by the forward rotation of the propeller 12. On the other hand, in a case where the dog clutch 18 is moved rearward under the control of the shift device 19, the teeth formed on the rear surface of the dog clutch 18 mesh with the teeth formed on the front surface of the reverse gear 16, and the dog clutch 18 and the reverse gear 16 are connected to each other. Thus, the rotation of the drive shaft 13 is transmitted to the propeller shaft 17 via the reverse gear 16, and the propeller shaft 17 and the propeller 12 rotate backward. A propulsion force that pushes the ship 1 rearward is generated by the reverse rotation of the propeller 12. In a case where the dog clutch 18 is positioned between the forward gear 15 and the reverse gear 16 under the control of the shift device 19, the dog clutch 18 is not connected to either the forward gear 15 or the reverse gear 16. In this case, the rotation of the drive shaft 13 is not transmitted to the propeller shaft 17. Thus, the propeller 12 stops rotating, so that the outboard motor 5 stops generating the propulsion force, and the propulsion force of the ship 1 becomes zero.

The shift device 19 is a device configured to switch between transmitting the power of the engine 6 to the propeller 12 via the forward gear 15 to cause the propeller 12 to rotate forward, transmitting the power of the engine 6 to the propeller 12 via the reverse gear 16 to cause the propeller 12 to rotate backward, and stopping the propeller 12 by not transmitting the power of the engine 6 to the propeller 12. The shift device 19 is configured to shift the dog clutch 18 to any one of a state where the dog clutch 18 is connected to the forward gear 15, a state where the dog clutch 18 is connected to the reverse gear 16, and a state where the dog clutch 18 is not connected to either the forward gear 15 or the reverse gear 16. The shift device 19 of the present embodiment is an electronically controlled shift device. The shift device 19 includes a shift actuator 20 disposed in the upper portion of the outboard motor 5, a shift rod 21 configured to transmit power of the shift actuator 20 to a clutch drive mechanism 22, and the clutch drive mechanism 22 configured to move the dog clutch 18 by the power of the shift actuator 20 transmitted via the shift rod 21.

The ECM 23 is a device configured to control the engine 6, and includes an arithmetic processing device and a storage device. Specifically, the ECM 23 is configured to transmit a valve control signal to the throttle device 10 to change the opening degree of the throttle valve 11. The ECM 23 is configured to transmit a clutch control signal to the shift device 19 to move the dog clutch 18. The throttle device 10 is provided with a throttle position sensor configured to detect a position of the throttle valve 11 (the opening degree of the throttle valve 11). The ECM 23 has a function of transmitting throttle position information indicating the position of the throttle valve 11 to the BCM 42, the automatic steering controller 51, and the like, based on a detection signal output from the throttle position sensor. The ECM 23 has a function of transmitting information indicating respective states of the engine 6 and the shift device 19 to the BCM 42, the display 56, and the like. In addition, the ECM 23 has a function of diagnosing an abnormality in the outboard motor 5 and transmitting the result to the BCM 42.

(Remote Control Device and Manual Steering Controller)

Figure 4:
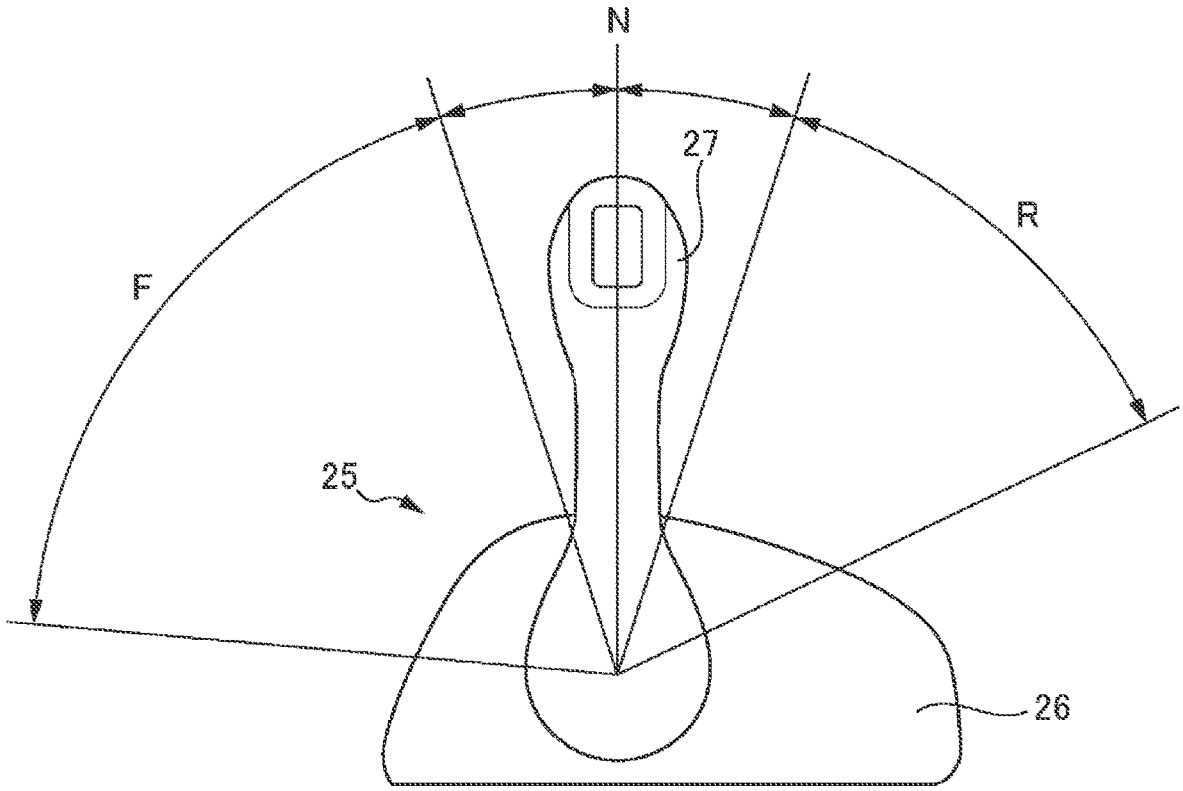
FIG. 4 is an explanatory diagram illustrating a remote control device provided in the ship in FIG. 1.

FIG. 4 shows the remote control device 25. In FIG. 4, the remote control device 25 includes a remote control device main body 26, and the operation lever 27. The crew member can move the ship forward or in reverse by tilting the operation lever 27 in a front-rear direction. For example, in a case where the operation lever 27 is raised vertically as shown in FIG. 4, a position of the operation lever 27 is a neutral position N. In a case where the operation lever 27 is tilted forward such that a forward inclination angle of the operation lever 27 with respect to a vertical direction is, for example, 18 degrees or more and 85 degrees or less, the position of the operation lever 27 is within a forward operation range F. In a case where the operation lever 27 is tilted rearward such that a rearward inclination angle of the operation lever 27 with respect to the vertical direction is, for example, 18 degrees or more and 65 degrees or less, the position of the operation lever 27 is within a reverse operation range R.

In a case where the position of the operation lever 27 is the neutral position N, the propulsion force of the ship 1 becomes zero. In a case where the position of the operation lever 27 is within the forward operation range F, the outboard motor 5 generates a propulsion force that pushes the ship 1 forward. Thus, the ship 1 moves forward. In a state where the position of the operation lever 27 is within the forward operation range F, as the forward inclination angle of the operation lever 27 with respect to the vertical direction increases, the propulsion force generated by the outboard motor 5 that pushes the ship 1 forward increases. Thus, a forward speed of the ship 1 increases. In a case where the position of the operation lever 27 is within the reverse operation range R, the outboard motor 5 generates a propulsion force that pushes the ship 1 rearward. Thus, the ship 1 moves in reverse. In a state where the position of the operation lever 27 is within the reverse operation range R, as the rearward inclination angle of the operation lever 27 with respect to the vertical direction increases, the propulsion force generated by the outboard motor 5 that pushes the ship 1 rearward increases. Thus, a reverse speed of the ship 1 increases.

The control of changing the propulsion force generated by the outboard motor 5 according to the position or inclination angle of the operation lever 27 is performed as follows, for example. The remote control device 25 is configured to output an operation signal indicating the position or inclination angle of the operation lever 27 to the BCM 42. The manual steering controller 43 is configured to acquire the operation signal and configured to output, to the ECM 23, a shift control signal for controlling the shift device 19 of the outboard motor 5, and a throttle control signal for controlling the throttle device 10 of the outboard motor 5, based on the operation signal. The ECM 23 is configured to output, to the throttle device 10, a clutch control signal for controlling the movement of the dog clutch 18 to the shift device 19, based on the shift control signal, and is configured to output a valve control signal for controlling the opening degree of the throttle valve 11, based on the throttle control signal.

Specifically, in a case where the position of the operation lever 27 is the neutral position N, the manual steering controller 43 is configured to output, to the ECM 23, a shift control signal for setting the state of the dog clutch 18 to the state where the dog clutch 18 is not connected to either the forward gear 15 or the reverse gear 16, based on the operation signal output from the remote control device 25. The ECM 23 is configured to output, to the shift device 19, a clutch control signal for moving the dog clutch 18 to an intermediate position between the forward gear 15 and the reverse gear 16, based on the shift control signal. Thus, the propeller 12 stops and the propulsion force of the ship 1 becomes zero. The engine 6 enters an idling state.

In a case where the operation lever 27 is tilted forward with respect to the vertical direction, the manual steering controller 43 is configured to output, to the ECM 23, a shift control signal for connecting the dog clutch 18 to the forward gear 15, based on the operation signal output from the remote control device 25. The ECM 23 is configured to output, to the shift device 19, a clutch control signal for moving the dog clutch 18 forward to connect the dog clutch 18 to the forward gear 15, based on the shift control signal. In a case where the operation lever 27 is tilted rearward with respect to the vertical direction, the manual steering controller 43 is configured to output, to the ECM 23, a shift control signal for connecting the dog clutch 18 to the reverse gear 16, based on the operation signal output from the remote control device 25. The ECM 23 is configured to output, to the shift device 19, a clutch control signal for moving the dog clutch 18 rearward to connect the dog clutch 18 to the reverse gear 16, based on the shift control signal.

In a case where the operation lever 27 is tilted forward with respect to the vertical direction and the position of the operation lever 27 is within the forward operation range F, the manual steering controller 43 outputs, to the ECM 23, a throttle control signal for setting the opening degree of the throttle valve 11 to an opening degree corresponding to an absolute value of an inclination angle of the operation lever 27 with respect to the vertical direction, based on the operation signal output from the remote control device 25. The ECM 23 is configured to output, to the throttle device 10, a valve control signal for setting the opening degree of the throttle valve 11 to an opening degree corresponding to the absolute value of the inclination angle of the operation lever 27 with respect to the vertical direction, based on the throttle control signal. Thus, the propeller 12 rotates forward, and a propulsion force that pushes the ship 1 forward is generated. As the opening degree of the throttle valve 11 increases, the propulsion force that pushes the ship 1 forward increases. In a case where the operation lever 27 within the forward operation range F is tilted toward the neutral position N and exits the forward operation range F, the manual steering controller 43 outputs a throttle control signal for fully closing the throttle valve 11 to the ECM 23, based on the operation signal output from the remote control device 25. The ECM 23 is configured to output a valve control signal for fully closing the throttle valve 11 to the throttle device 10, based on the throttle control signal.

In a case where the operation lever 27 is tilted rearward with respect to the vertical direction and the position of the operation lever 27 is within the reverse operation range R, the manual steering controller 43 outputs, to the ECM 23, a throttle control signal for setting the opening degree of the throttle valve 11 to an opening degree corresponding to an absolute value of an inclination angle of the operation lever 27 with respect to the vertical direction, based on the operation signal output from the remote control device 25. The ECM 23 is configured to output, to the throttle device 10, a valve control signal for setting the opening degree of the throttle valve 11 to an opening degree corresponding to the absolute value of the inclination angle of the operation lever 27 with respect to the vertical direction, based on the throttle control signal. Thus, the propeller 12 rotates in reverse, and a propulsion force that pushes the ship 1 rearward is generated. As the opening degree of the throttle valve 11 increases, the propulsion force that pushes the ship 1 rearward increases. In a case where the operation lever 27 within the reverse operation range R is tilted toward the neutral position N and exits the reverse operation range R, the manual steering controller 43 outputs a throttle control signal for fully closing the throttle valve 11 to the ECM 23, based on the operation signal output from the remote control device 25. The ECM 23 is configured to output a valve control signal for fully closing the throttle valve 11 to the throttle device 10, based on the throttle control signal.

(Automatic Steering Controller)

The automatic steering controller 51 in FIG. 1 has a function of recognizing the current position of the ship 1 based on GPS, nautical chart data, and the like. Specifically, the GPS antenna 52 is configured to output the information transmitted from GPS satellites via radio waves to the automatic steering controller 51. The nautical chart data is stored in a storage device built in the plotter 53. The automatic steering controller 51 is configured to recognize the current position of the ship 1 using the information transmitted from GPS satellites via radio waves, the nautical chart data, and the like.

The automatic steering controller 51 has a function of automatically steering the ship 1 along a route set by the crew member without the operation of the handle 32. Specifically, the crew member can set a destination to which the ship 1 is automatically steered and a route from the current position of the ship 1 to the destination using the plotter 53. The plotter 53 is configured to store, in the storage device built in the plotter 53, route information indicating the route set by the crew member. The automatic steering controller 51 s configured to acquire the route information from the plotter 53 and configured to output, to the steering angle controller 54, a steering control signal for steering the ship 1 based on the route information. The steering angle controller 54 is configured to control the hydraulic steering actuator 31 based on the steering control signal, and is configured to automatically change the traveling direction of the ship 1 such that the ship 1 sails on the route set by the crew member.

The automatic steering controller 51 has a function of automatically changing the propulsion force of the ship 1, without the operation of the operation lever 27 of the remote control device 25, such that the ship 1 smoothly sails on the route set by the crew member. Specifically, the automatic steering controller 51 is configured to control the outboard motor 5 via the BCM 42 to change the propulsion force of the ship 1, in order to maintain a constant speed of the ship 1 traveling straight on the route set by the crew member. For example, in a case where the ship is traveling straight on the route set by the crew member, the automatic steering controller 51 controls the outboard motor 5 via the BCM 42 and changes the propulsion force generated by the outboard motor 5 so as to cancel out a change in the speed of the ship 1 due to the influence of water currents, wind, or the like. To turn the ship 1 at a course changing position on the route set by the crew member, the automatic steering controller 51 is configured to control the outboard motor 5 via the BCM 42 to change the propulsion force of the ship 1, in order to suppress overshoot during turning of the ship 1. For example, the automatic steering controller 51 is configured to control the outboard motor 5 via the BCM 42 to reduce the propulsion force generated by the outboard motor 5 such that the ship 1 decelerates, immediately before the ship 1 is turned at the course changing position on the route set by the crew member and while the ship 1 is turning. For example, the automatic steering controller 51 is configured to control the outboard motor 5 via the BCM 42 to increase the propulsion force generated by the outboard motor 5 such that the speed of the ship 1 returns to the speed during straight traveling, after the ship 1 finishes turning.

To start the automatic steering of the ship 1 by the automatic steering controller 51, the crew member first uses the plotter 53 to set a destination to which the ship 1 is automatically steered and a route from the current position of the ship 1 to the destination, and inputs an instruction to start the automatic steering. Next, the crew member tilts the operation lever 27 of the remote control device 25 forward with respect to the vertical direction to adjust the inclination angle of the operation lever 27 such that the forward speed of the ship 1 becomes a desired speed. The automatic steering controller 51 is configured to start the automatic steering, in a case where the forward speed of the ship 1 is stabilized. During the automatic steering, in a case where a navigation state of the ship 1 and the situation around the ship 1 are safe and the ship 1 or the devices provided on the ship 1 are operating normally, the crew member basically does not need to operate the remote control device 25 or the handle 32.

For example, the automatic steering controller 51 is configured to control to change the propulsion force generated by the outboard motor 5 during the automatic steering as follows. During the automatic steering, the automatic steering controller 51 is configured to transmit, to the BCM 42, a command signal for increasing or decreasing the propulsion force of the ship 1. The BCM 42 is configured to output, to the ECM 23, a throttle control signal for controlling the throttle device 10 of the outboard motor 5, based on the command signal. The ECM 23 is configured to output a valve control signal to the throttle device 10, based on the throttle control signal.

In addition, the automatic steering controller 51 has a function of diagnosing an abnormality thereof and transmitting the result to the BCM 42.

(Abnormality Detection Unit)

The abnormality detection unit 44 in FIG. 2 is configured to detect an abnormality in the automatic steering operation by the automatic steering controller 51. The abnormality in the automatic steering operation by the automatic steering controller 51 includes an abnormality in the automatic steering controller 51 (that is, an abnormality in the automatic steering controller 51 itself, such as an abnormality inside the automatic steering controller 51), an abnormality in the outboard motor 5, and an abnormality in communication between the automatic steering controller 51 and the outboard motor 5. The abnormality detection unit 44 is configured to detect, as the abnormality in the automatic steering operation by the automatic steering controller 51, an abnormality in the automatic steering controller 51, an abnormality in the outboard motor 5, and an abnormality in communication between the automatic steering controller 51 and the outboard motor 5.

The automatic steering controller 51 is configured to transmit, to the abnormality detection unit 44, abnormality information indicating an abnormality in the automatic steering controller 51. The abnormality detection unit 44 is configured to receive the abnormality information transmitted from the automatic steering controller 51, and configured to detect an abnormality in the automatic steering controller 51 based on the abnormality information.

The outboard motor 5 is configured to transmit, to the abnormality detection unit 44, abnormality information indicating an abnormality in the outboard motor 5. The abnormality detection unit 44 is configured to receive the abnormality information transmitted from the outboard motor 5, and configured to detect an abnormality in the outboard motor 5 based on the abnormality information.

During the automatic steering, a command signal is transmitted from the automatic steering controller 51 to the BCM 42, and a throttle control signal is transmitted from the BCM 42 to the ECM 23. The ECM 23 is configured to transmit throttle position information to the automatic steering controller 51 via the BCM 42. The abnormality detection unit 44 is configured to monitor a transmission status of the signals or the information during the automatic steering, and configured to detect an abnormality in the transmission status of the signals or the information, as an abnormality in the communication between the automatic steering controller 51 and the outboard motor 5. For example, in a case where the frequency of a transmission error of the command signal, the throttle control signal, or the throttle position information is higher than a predetermined reference, or in a case where the transmission timing of the command signal, the throttle control signal, or the throttle position information is different from a predetermined timing, the abnormality detection unit 44 recognizes that an abnormality occurs in the communication between the automatic steering controller 51 and the outboard motor 5.

(Steering Mode Switching Unit)

In a case where an abnormality occurs in the automatic steering operation during the automatic steering of the ship 1, the steering mode switching unit 45 switches the steering mode of the ship 1 from the automatic steering to the manual steering. Specifically, in a case where an abnormality in the automatic steering operation is detected by the abnormality detection unit 44 when the outboard motor 5 is controlled by the automatic steering controller 51, the steering mode switching unit 45 switches the control of the outboard motor 5 from the control by the automatic steering controller 51 to the control by the manual steering controller 43.

As shown in FIG. 2, the steering mode switching unit 45 includes an automatic steering cancellation unit 46, a propulsion force gradual reduction controller 47, an operation position determination unit 48, a manual steering start unit 49, and a notification request output controller 50. The automatic steering cancellation unit 46, the propulsion force gradual reduction controller 47, the operation position determination unit 48, the manual steering start unit 49, and the notification request output controller 50 are implemented by, for example, the arithmetic processing device of the BCM 42 reading and executing programs stored in the storage device of the BCM 42. The BCM 42 may function as the automatic steering cancellation unit 46, the propulsion force gradual reduction controller 47, the operation position determination unit 48, the manual steering start unit 49, and the notification request output controller 50.

In a case where an abnormality in the automatic steering operation of the automatic steering controller 51 is detected by the abnormality detection unit 44, the automatic steering cancellation unit 46 cancels the control of the outboard motor 5 by the automatic steering controller 51.

After the automatic steering cancellation unit 46 cancels the control of the outboard motor 5 by the automatic steering controller 51, the propulsion force gradual reduction controller 47 gradually reduces the propulsion force of the ship 1 by controlling the outboard motor 5 until the propulsion force of the ship 1 becomes zero.

The operation position determination unit 48 determines whether the position of the operation lever 27 of the remote control device 25 is the neutral position N, after the propulsion force of the ship 1 becomes zero under the control of the outboard motor 5 by the propulsion force gradual reduction controller 47.

After the propulsion force of the ship 1 becomes zero under the control of the outboard motor 5 by the propulsion force gradual reduction controller 47, the manual steering start unit 49 maintains the propulsion force of the ship 1 at zero, until the operation position determination unit 48 determines that the position of the operation lever 27 is the neutral position N, and starts the control of the outboard motor 5 by the manual steering controller 43, after the operation position determination unit 48 determines that the position of the operation lever 27 is the neutral position N.

The notification request output controller 50 is configured to notify the crew member of an abnormality in the automatic steering operation, and configured to request the crew member to switch the steering mode.

(Steering Mode Switching Process)

Figure 5:
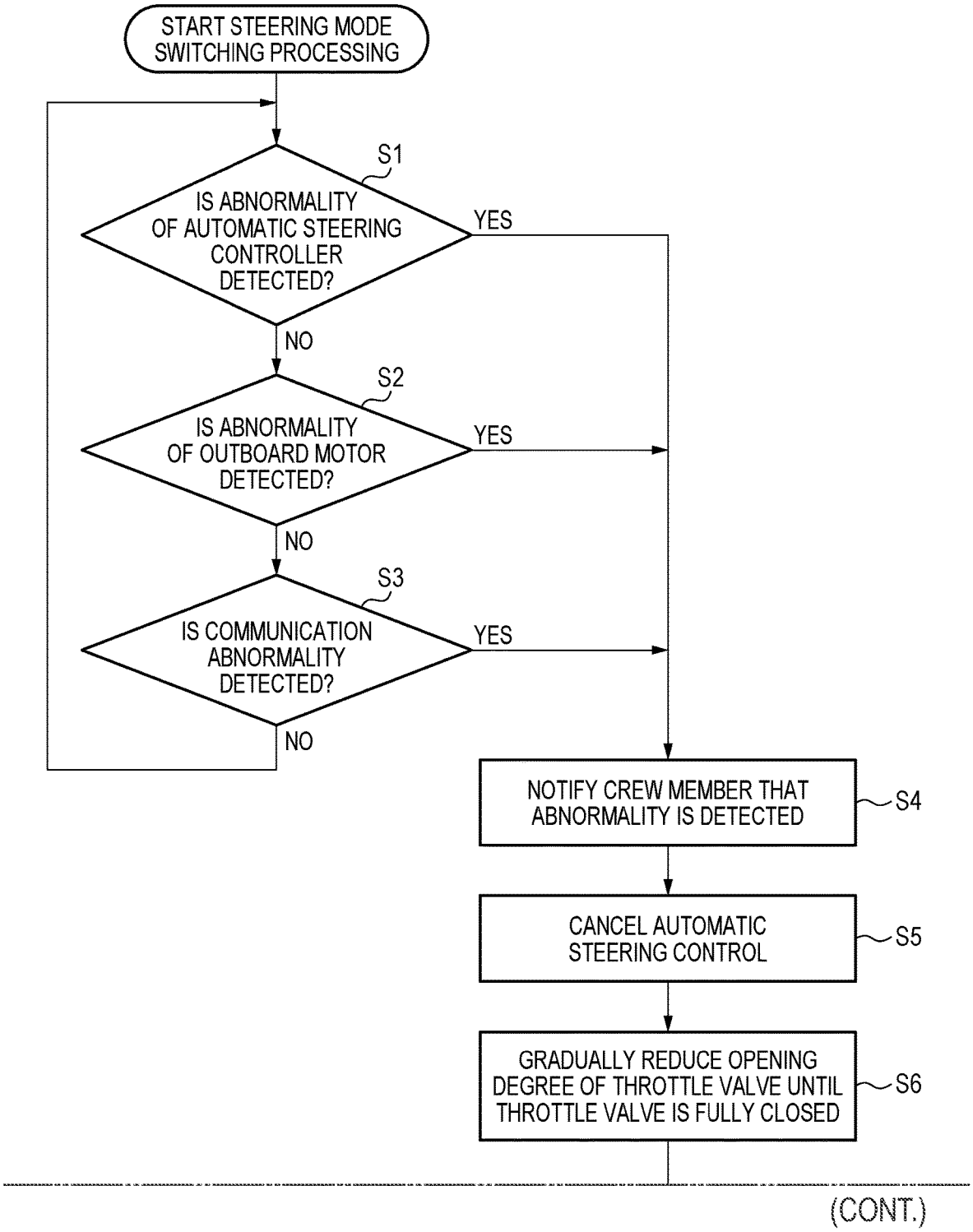
FIG. 5 is a flowchart illustrating a steering mode switching process in the ship steering control device according to the first exemplary embodiment of the present invention.

FIG. 5 shows a steering mode switching process. The steering mode switching processing is processing of monitoring the presence or absence of an abnormality in the automatic steering operation during the automatic steering of the ship 1, and of switching the steering mode of the ship 1 from the automatic steering to the manual steering, in a case where an abnormality occurs in the automatic steering operation during the automatic steering of the ship 1. The steering mode switching processing is started in a case where the automatic steering of the ship 1 is started, that is, in a case where the control of the outboard motor 5 by the automatic steering controller 51 is started. The steering mode switching processing will be described with reference to FIG. 5.

Immediately after the automatic steering of the ship 1 is started, the abnormality detection unit 44 monitors the presence or absence of an abnormality in the automatic steering operation by the automatic steering controller 51, specifically, the presence or absence of an abnormality in the automatic steering controller 51, an abnormality in the outboard motor 5, and an abnormality in the communication between the automatic steering controller 51 and the outboard motor 5 (steps S1 to S3).

In a case where the abnormality detection unit 44 detects an abnormality in the automatic steering controller 51 (step S1: YES), detects an abnormality in the outboard motor 5 (step S2: YES), or detects an abnormality in the communication between the automatic steering controller 51 and the outboard motor 5 (step S3: YES), the notification request output controller 50 notifies the crew member that an abnormality is detected (step S4). For example, the notification request output controller 50 displays on the display 56 that an abnormality is detected.

Subsequently, the automatic steering cancellation unit 46 cancels the control of the outboard motor 5 by the automatic steering controller 51 (step S5). For example, the automatic steering cancellation unit 46 transmits an automatic steering stop signal, which is a control signal for stopping the control of the outboard motor 5 by the automatic steering controller 51, to the automatic steering controller 51. Thus, the control of the outboard motor 5 by the automatic steering controller 51 is stopped.

Subsequently, the propulsion force gradual reduction controller 47 controls the outboard motor 5 to gradually reduce the opening degree of the throttle valve 11 until the throttle valve 11 is fully closed (step S6). For example, the propulsion force gradual reduction controller 47 repeats a series of processing of transmitting a throttle gradual reduction control signal, which is a control signal for reducing the opening degree of the throttle valve 11 by a predetermined amount, to the ECM 23, transmitting a throttle position information request signal, which is a signal for requesting transmission of throttle position information, to the ECM 23, and determining whether the throttle valve 11 is fully closed based on the throttle position information transmitted from the ECM 23 according to the throttle position information request signal, at predetermined intervals until it is determined that the throttle valve 11 is fully closed. In step S6, the ECM 23 outputs a valve control signal for reducing the opening degree of the throttle valve 11 by a predetermined amount to the throttle device 10, based on the throttle gradual reduction control signal transmitted from the propulsion force gradual reduction controller 47. Thus, the opening degree of the throttle valve 11 is reduced by a predetermined amount. Next, the ECM 23 transmits the throttle position information to the propulsion force gradual reduction controller 47 according to the throttle position information request signal transmitted from the propulsion force gradual reduction controller 47. According to the processing of the propulsion force gradual reduction controller 47 and the ECM 23 in step S6, the opening degree of the throttle valve 11 gradually decreases and the throttle valve 11 is fully closed. Thus, the propulsion force of the ship 1 gradually decreases.

After the throttle valve 11 is fully closed, the propulsion force gradual reduction controller 47 releases the connection between the dog clutch 18 and the forward gear 15 by controlling the outboard motor 5 (step S7). For example, the propulsion force gradual reduction controller 47 transmits, to the ECM 23, a disconnection control signal for bringing the dog clutch 18 into the state where the dog clutch 18 is not connected to either the forward gear 15 or the reverse gear 16. The ECM 23 outputs, to the shift device 19, a clutch control signal for moving the dog clutch 18 to an intermediate position between the forward gear 15 and the reverse gear 16, based on the disconnection control signal transmitted from the propulsion force gradual reduction controller 47. Thus, the dog clutch 18 is moved to an intermediate position between the forward gear 15 and the reverse gear 16, the connection between the dog clutch 18 and the forward gear 15 is released, and the dog clutch 18 is in the state of not being connected to either the forward gear 15 or the reverse gear 16. As a result, the power of the engine 6 is no longer transmitted to the propeller 12, so that the propeller 12 stops, and the propulsion force of the ship 1 becomes zero.

Subsequently, the notification request output controller 50 requests the crew member to return the position of the operation lever 27 of the remote control device 25 to the neutral position N (step S8). For example, the notification request output controller 50 displays, on the display 56, a message requesting that the position of the operation lever 27 be returned to the neutral position N. To start the automatic steering of the ship 1 by the automatic steering controller 51, the crew member tilts the operation lever 27 forward with respect to the vertical direction and adjusts the inclination angle of the operation lever 27 such that the forward speed of the ship 1 becomes a desired speed. Therefore, at the time when step S8 is executed, the position of the operation lever 27 is not the neutral position N. The crew member returns the position of the operation lever 27 to the neutral position N in response to the request from the notification request output controller 50.

Subsequently, the operation position determination unit 48 determines whether the position of the operation lever 27 of the remote control device 25 is the neutral position N (step S9). This determination can be performed based on an operation signal output from the remote control device 25 to the BCM 42, and the operation signal is acquired by the operation position determination unit 48. In a case where the crew member returns the position of the operation lever 27 to the neutral position N, the operation position determination unit 48 determines that the position of the operation lever 27 is the neutral position N.

The manual steering start unit 49 maintains the propulsion force of the ship 1 at zero, after the propulsion force of the ship 1 becomes zero under the control of the outboard motor 5 by the propulsion force gradual reduction controller 47, until the operation position determination unit 48 determines that the position of the operation lever 27 is the neutral position N. That is, during this period, the throttle valve 11 remains fully closed, and the dog clutch 18 remains intermediate between the forward gear 15 and the reverse gear 16. Then, after the operation position determination unit 48 determines that the position of the operation lever 27 is the neutral position N (step S9: YES), the manual steering start unit 49 causes the manual steering controller 43 to start the control of the outboard motor 5. After the control of the outboard motor 5 by the automatic steering controller 51 is canceled in step S5, until immediately before the control of the outboard motor 5 by the manual steering controller 43 is started in step S10, the outboard motor 5 does not operate according to the operation of the operation lever 27 even in a case where the crew member operates the operation lever 27. On the other hand, after the control of the outboard motor 5 by the manual steering controller 43 is started in step S10, the outboard motor 5 operates according to the operation of the operation lever 27 by the crew member. In a case where the automatic steering of the ship 1 ends without any abnormality in the automatic steering operation being detected in steps S1 to S3, the steering mode switching process ends.

As described above, in the ship steering control device 41 of the first embodiment of the present disclosure, in a case where an abnormality in the automatic steering operation by the automatic steering controller 51 is detected, the control of the outboard motor 5 by the automatic steering controller 51 is canceled, and then the propulsion force of the ship 1 is gradually decreased until the propulsion force of the ship 1 becomes zero. Thereafter, the propulsion force of the ship 1 is maintained at zero, until it is determined that the position of the operation lever 27 of the remote control device 25 is the neutral position N. That is, the ship steering control device 41 waits while maintaining the propulsion force of the ship 1 at zero, until the crew member moves the operation lever 27 to the neutral position N. Then, in a case where the crew member moves the operation lever 27 to the neutral position N, it is determined that the position of the operation lever 27 is the neutral position N, and the control of the outboard motor 5 by the manual steering controller 43 is started. According to the ship steering control device 41 configured to perform such processing, in a case where the automatic steering operation is abnormal, the propulsion force generated by the outboard motor 5 is zero and the position of the operation lever 27 is the neutral position N, immediately before the control of the outboard motor 5 by the manual steering controller 43 is started. That is, immediately before the control of the outboard motor 5 by the manual steering controller 43 is started when the automatic steering operation is abnormal, the position of the operation lever 27 matches the propulsion force (=zero) generated by the outboard motor 5. Therefore, in a case where the crew member then operates the operation lever 27 to start the manual steering of the ship 1, it is possible to prevent the speed of the ship 1 from suddenly changing against the intention of the crew member, and it is possible to prevent the crew member from feeling uncomfortable that the operation of the operation lever 27 and the movement of the ship 1 do not match.

In the ship steering control device 41 of the present embodiment, in a case where an abnormality in the automatic steering operation by the automatic steering controller 51 is detected, the control of the outboard motor 5 by the manual steering controller 43 is not started, until the propulsion force of the ship 1 becomes zero and the position of the operation lever 27 returns to the neutral position N, after the control of the outboard motor 5 by the automatic steering controller 51 is canceled. In other words, the control of the outboard motor 5 based on the operation of the operation lever 27 by the crew member is not performed, during the time when the inclination angle of the operation lever 27 and the propulsion force generated by the outboard motor 5 may be deviated after the control of the outboard motor 5 by the automatic steering controller 51 is canceled. Thus, it is possible to prevent a sudden change in the speed of the ship 1 when the crew member returns the position of the operation lever 27 to the neutral position N according to a request to return the position of the operation lever 27 to the neutral position N (step S8 in FIG. 5), during the execution of the steering mode switching process.

In the ship steering control device 41 of the present embodiment, the abnormality detection unit 44 detects, as an abnormality in the automatic steering operation by the automatic steering controller 51, an abnormality in the automatic steering controller 51, an abnormality in the outboard motor 5, and an abnormality in the communication between the automatic steering controller 51 and the outboard motor 5. Thus, abnormalities that may interfere with the automatic steering of the ship 1 can be detected over a wide range.

In the ship steering control device 41 of the present embodiment, the abnormality detection unit 44 detects an abnormality in the automatic steering controller 51 by receiving abnormality information transmitted from the automatic steering controller 51. Thus, an abnormality in the automatic steering controller 51 can be easily detected.

Second Embodiment

The first embodiment described above is an embodiment in which the ship steering control device of the present invention is applied to the ship 1 provided with one outboard motor 5, whereas the second embodiment is an embodiment in which the ship steering control device of the present invention is applied to a ship 71 provided with two outboard motors 73 and 74.

Figure 6:
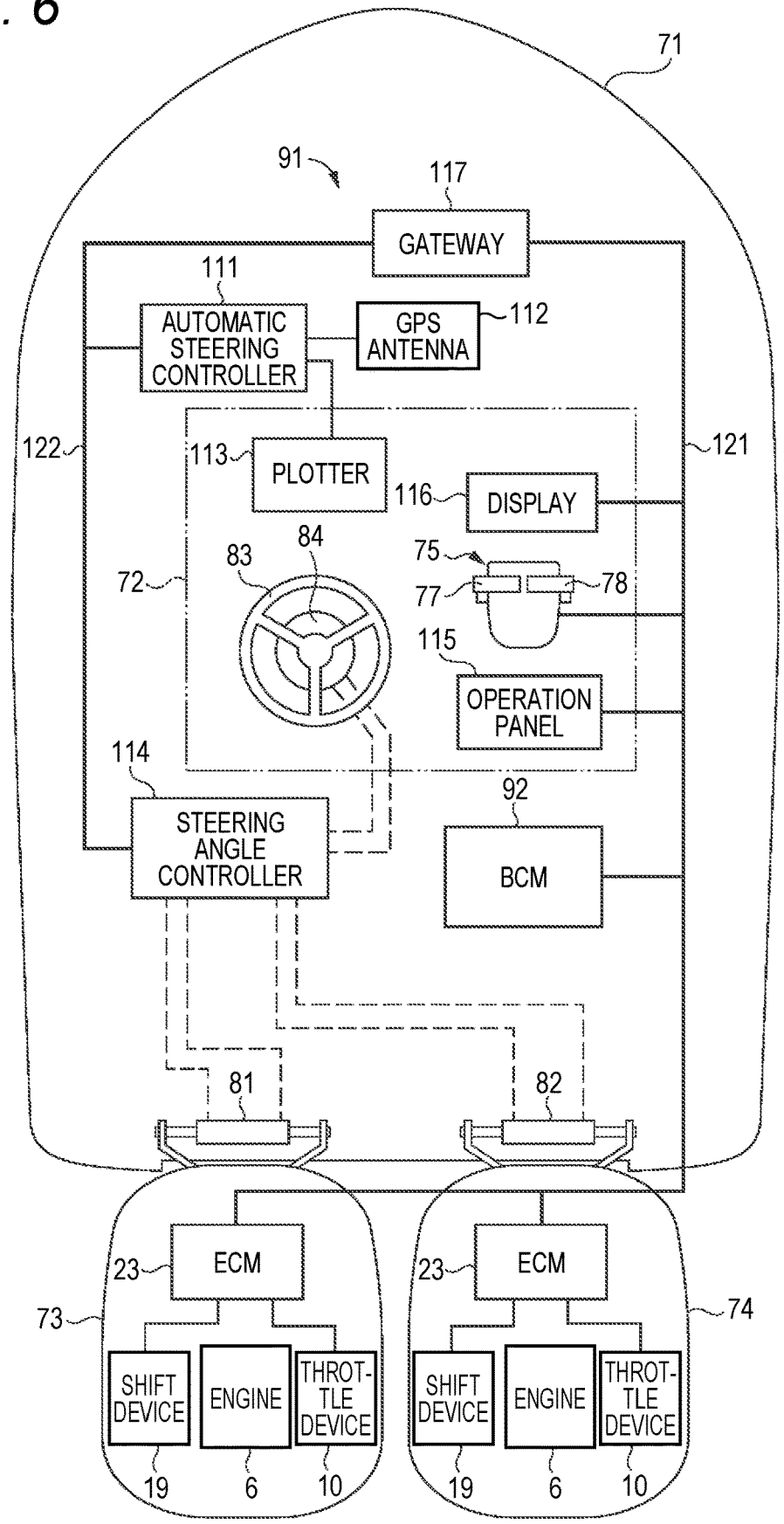
FIG. 6 is an explanatory diagram illustrating a ship to which a ship steering control device according to according to a second exemplary embodiment of the present invention is applied.
Figure 7:
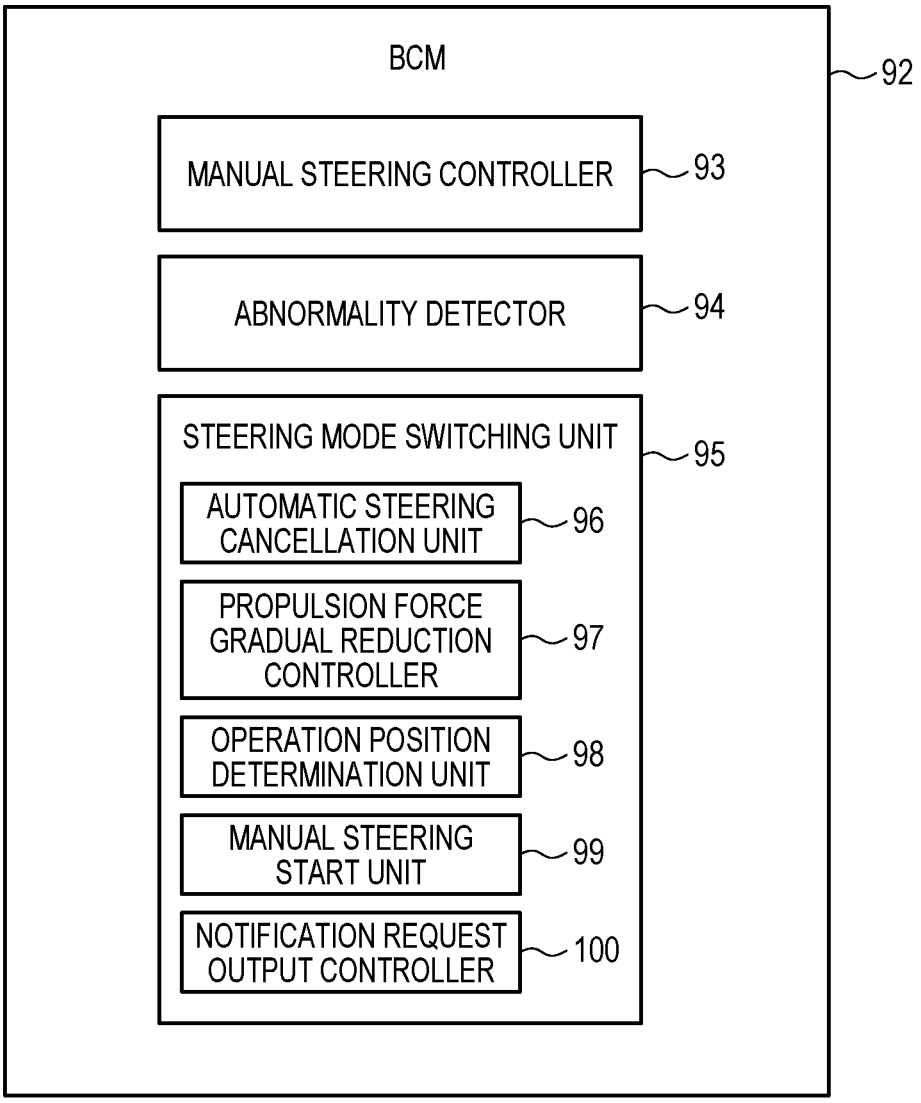
FIG. 7 is an explanatory diagram illustrating a BCM provided in the ship in FIG. 6.
Figure 8:
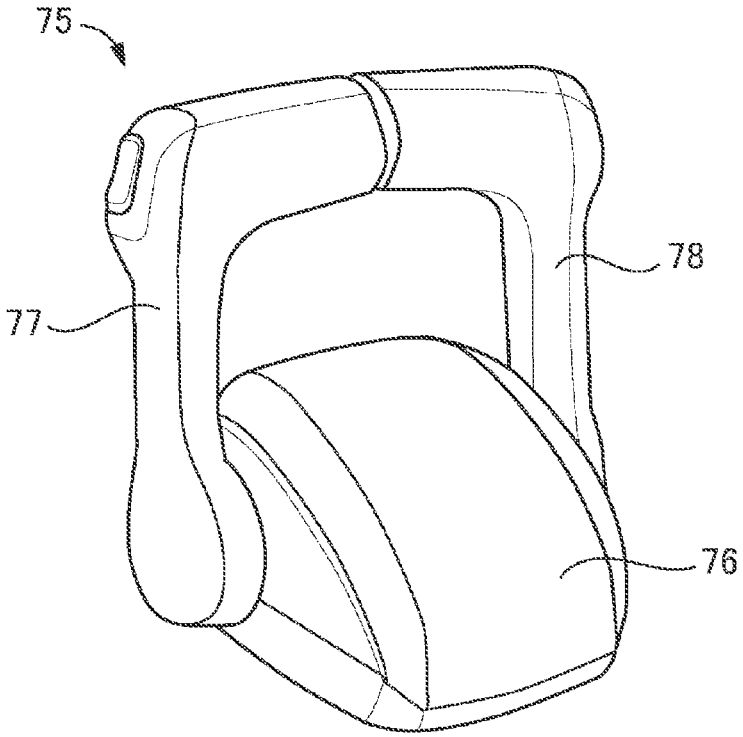
FIG. 8 is an explanatory diagram illustrating a remote control device provided in the ship in FIG. 6.

FIG. 6 shows the ship 71 provided with a ship steering control device 91 according to the second embodiment of the present invention. FIG. 7 shows a BCM 92 provided in the ship 71. FIG. 8 shows a remote control device 75 provided in a cockpit 72 of the ship 71.

As shown in FIG. 6, the ship 71 is provided with two outboard motors 73 and 74, the remote control device 75, two hydraulic steering actuators 81 and 82, a handle 83, a helm pump 84, and the ship steering control device 91.

The outboard motors 73 and 74 each have the same configuration as the outboard motor 5 in the first embodiment. Among the components of the outboard motors 73 and 74, the same components as the components of the outboard motor 5 in the first embodiment are denoted by the same reference numerals, and the description thereof is omitted. The outboard motor 73 is attached to a left side of a stern of a hull of the ship 71, and the outboard motor 74 is attached to a right side of the stern of the hull of the ship 71.

The remote control device 75 is a device configured to remotely control the two outboard motors 73 and 74. As shown in FIG. 8, the remote control device 75 includes a remote control device main body 76 and two operation levers 77 and 78. In the remote control device 75, one operation lever 77 is an operation lever for manually operating one outboard motor 73, and the other operation lever 78 is an operation lever for manually operating the other outboard motor 74. For example, in a case where the operation lever 77 is raised vertically, a position of the operation lever 77 is a neutral position. In a case where the operation lever 77 is tilted forward such that a forward inclination angle of the operation lever 77 with respect to a vertical direction is, for example, 18 degrees or more and 85 degrees or less, the position of the operation lever 77 is within a forward operation range. In a case where the operation lever 77 is tilted rearward such that a rearward inclination angle of the operation lever 77 with respect to the vertical direction is, for example, 18 degrees or more and 65 degrees or less, the position of the operation lever 77 is within a reverse operation range. The operation of the outboard motor 73 according to the operation of the operation lever 77 is the same as the operation of the outboard motor 5 according to the operation of the operation lever 27 in the first embodiment. In a case where the operation lever 78 is raised vertically, a position of the operation lever 78 is a neutral position. In a case where the operation lever 78 is tilted forward such that a forward inclination angle of the operation lever 78 with respect to a vertical direction is, for example, 18 degrees or more and 85 degrees or less, the position of the operation lever 78 is within a forward operation range. In a case where the operation lever 78 is tilted rearward such that a rearward inclination angle of the operation lever 78 with respect to the vertical direction is, for example, 18 degrees or more and 65 degrees or less, the position of the operation lever 78 is within a reverse operation range. The operation of the outboard motor 74 according to the operation of the operation lever 78 is the same as the operation of the outboard motor 5 according to the operation of the operation lever 27 in the first embodiment.

When moving the ship 71 forward, a crew member usually tilts the operation lever 77 and the operation lever 78 forward at the same time so that the positions of the operation lever 77 and the operation lever 78 are within the forward operation range and the forward inclination angle of the operation lever 77 with respect to the vertical direction and the forward inclination angle of the operation lever 78 with respect to the vertical direction are equal to each other. When moving the ship 71 in reverse, the crew member usually tilts the operation lever 77 and the operation lever 78 rearward at the same time so that the positions of the operation lever 77 and the operation lever 78 are within the reverse operation range and the rearward inclination angle of the operation lever 77 with respect to the vertical direction and the rearward inclination angle of the operation lever 78 with respect to the vertical direction are equal to each other. In addition, in a case where the crew member moves the operation lever 77 and the operation lever 78 to the neutral position, the outboard motor 73 and the outboard motor 74 are in a state of not generating a propulsion force, and the propulsion force of the ship 71 becomes zero.

The hydraulic steering actuator 81 is a device configured to change a horizontal orientation of the outboard motor 73 with respect to the ship 71, and the hydraulic steering actuator 82 is a device configured to change a horizontal orientation of the outboard motor 74 with respect to the ship 71. The handle 83 is a device for the crew member to manually operate the two hydraulic steering actuators 81 and 82. The helm pump 84 is a hydraulic pump for controlling the two hydraulic steering actuators 81 and 82 according to the operation of the handle 83 using a hydraulic pressure.

The ship steering control device 91 is a device configured to control the operation of the ship 71 provided with the two outboard motors 73 and 74. The ship steering control device 91 includes the BCM 92, an automatic steering controller 111, a GPS antenna 112, a plotter 113, a steering angle controller 114, an operation panel 115, a display 116, and a gateway 117.

As shown in FIG. 7, the BCM 92 includes a manual steering controller 93, an abnormality detection unit 94, and a steering mode switching unit 95.

The manual steering controller 93 is configured to control the two outboard motors 73 and 74 according to the operation of the remote control device 75. Specifically, the remote control device 75 is configured to output an operation signal indicating the inclination angle of the operation lever 77 to the BCM 92. The manual steering controller 93 is configured to acquire the operation signal and configured to output, to the ECM 23 of the outboard motor 73, a shift control signal for controlling the shift device 19 of the outboard motor 73 and a throttle control signal for controlling the throttle device 10 of the outboard motor 73, based on the operation signal. The remote control device 75 is configured to output an operation signal indicating the inclination angle of the operation lever 78 to the BCM 92. The manual steering controller 93 is configured to acquire the operation signal and configured to output, to the ECM 23 of the outboard motor 74, a shift control signal for controlling the shift device 19 of the outboard motor 74 and a throttle control signal for controlling the throttle device 10 of the outboard motor 74, based on the operation signal.

The abnormality detection unit 94 is configured to detect an abnormality in an automatic steering operation by the automatic steering controller 111. Specifically, the abnormality detection unit 94 is configured to detect, as the abnormality in the automatic steering operation by the automatic steering controller 111, an abnormality in the automatic steering controller 111, an abnormality in the outboard motor 73, an abnormality in the outboard motor 74, an abnormality in communication between the automatic steering controller 111 and the outboard motor 73, and an abnormality in communication between the automatic steering controller 111 and the outboard motor 74.

In a case where an abnormality occurs in the automatic steering operation during automatic steering of the ship 71, the steering mode switching unit 95 switches a steering mode of the ship 71 from automatic steering to manual steering. Specifically, in a case where an abnormality in the automatic steering operation is detected by the abnormality detection unit 94 when the outboard motors 73 and 74 is controlled by the automatic steering controller 111, the steering mode switching unit 95 switches the control of the outboard motors 73 and 74 from the control by the automatic steering controller 111 to the control by the manual steering controller 93. As shown in FIG. 7, the steering mode switching unit 95 includes an automatic steering cancellation unit 96, a propulsion force gradual reduction controller 97, an operation position determination unit 98, a manual steering start unit 99, and a notification request output controller 100. In a case where an abnormality in the automatic steering operation of the automatic steering controller 111 is detected by the abnormality detection unit 94, the automatic steering cancellation unit 96 cancels the control of the outboard motors 73 and 74 by the automatic steering controller 111. After the automatic steering cancellation unit 96 cancels the control of the outboard motors 73 and 74 by the automatic steering controller 111, the propulsion force gradual reduction controller 97 gradually reduces the propulsion force of the ship 71 by controlling the outboard motors 73 and 74, until the propulsion force of the ship 71 becomes zero. The operation position determination unit 98 is configured to determine whether both the position of the operation lever 77 and the position of the operation lever 78 of the remote control device 75 are in the neutral position after the propulsion force of the ship 71 becomes zero under the control of the outboard motors 73 and 74 by the propulsion force gradual reduction controller 97. After the propulsion force of the ship 71 becomes zero under the control of the outboard motors 73 and 74 by the propulsion force gradual reduction controller 97, the manual steering start unit 99 maintains the propulsion force of the ship 71 at zero, until the operation position determination unit 98 determines that both the position of the operation lever 77 and the position of the operation lever 78 are the neutral position, and starts control of the outboard motors 73 and 74 by the manual steering controller 93, after the operation position determination unit 98 determines that both the position of the operation lever 77 and the position of the operation lever 78 are the neutral position. The notification request output controller 100 is configured to notify the crew member of an abnormality in the automatic steering operation, and configured to request the crew member to switch the steering mode.

The automatic steering controller 111 is a device for performing the automatic steering of the ship 71 provided with the two outboard motors 73 and 74. The automatic steering controller 111 is a specific example of the "automatic steering controller". The GPS antenna 112 is the same as the GPS antenna 52 in the first embodiment. The plotter 113 is the same as the plotter 53 in the first embodiment.

During the automatic steering, the automatic steering controller 111 is configured to control the two hydraulic steering actuators 81 and 82 via the steering angle controller 114, and configured to automatically change a traveling direction of the ship 71 without the operation of the handle 83 such that the ship 71 sails on a route set by the crew member.

In addition, during the automatic steering, the automatic steering controller 111 is configured to control the two outboard motors 73 and 74 via the BCM 92, and configured to automatically change the propulsion force of the ship 71 without the operation of either the operation lever 77 or the operation lever 78 of the remote control device 75 such that the ship 71 smoothly sails on a route set by the crew member. Specifically, the automatic steering controller 111 is configured to control the outboard motors 73 and 74 via the BCM 92 to change the propulsion force of the ship 71, in order to maintain a constant speed of the ship 71 traveling straight on the route set by the crew member. To turn the ship 71 at a course changing position on the route set by the crew member, the automatic steering controller 111 is configured to control the outboard motors 73 and 74 via the BCM 92 to change the propulsion force of the ship 71, in order to suppress overshoot during turning of the ship 71.

To start the automatic steering of the ship 71 by the automatic steering controller 111, the crew member first uses the plotter 113 to set a destination to which the ship 71 is automatically steered and a route from the current position of the ship 71 to the destination, and inputs an instruction to start the automatic steering. Next, the crew member tilts the operation lever 77 and the operation lever 78 of the remote control device 75 forward with respect to the vertical direction at the same time, and adjusts the inclination angles of the operation lever 77 and the operation lever 78 such that a forward speed of the ship 71 becomes a desired speed. The automatic steering controller 111 starts the automatic steering when the forward speed of the ship 71 is stabilized.

The steering angle controller 114 is a device configured to control the two hydraulic steering actuators 81 and 82, based on an electric signal (steering control signal) output from the automatic steering controller 111, during the automatic steering. The steering angle controller 114 is substantially the same as the steering angle controller 54 in the first embodiment except that the steering angle controller 114 has a configuration configured to control the two hydraulic steering actuators 81 and 82.

The operation panel 115 is a device mainly for starting and stopping the outboard motors 73 and 74. The display 116 is the same as the display 56 in the first embodiment.

The ECM 23 of the outboard motor 73, the ECM 23 of the outboard motor 74, the remote control device 75, the BCM 92, the operation panel 115, and the display 116 are electrically connected to one another via a first network 121. The automatic steering controller 111 and the steering angle controller 114 are electrically connected to each other via a second network 122. The first network 121 and the second network 122 are electrically connected to each other via the gateway 117. CAN is used for communication between the devices, for example.

The steering mode switching unit 95 is configured to perform a steering mode switching processing. The steering mode switching processing is processing of monitoring the presence or absence of an abnormality in the automatic steering operation during the automatic steering of the ship 71, and of switching the steering mode of the ship 71 from the automatic steering to the manual steering in a case where an abnormality occurs in the automatic steering operation during the automatic steering of the ship 71. The steering mode switching processing in the second embodiment will be described with reference to FIG. 5.

During the automatic steering of the ship 71, the abnormality detection unit 94 monitors the presence or absence of an abnormality in the automatic steering operation by the automatic steering controller 111, specifically, the presence or absence of an abnormality in the automatic steering controller 111, an abnormality in the outboard motor 73, an abnormality in the outboard motor 74, an abnormality in the communication between the automatic steering controller 111 and the outboard motor 73, and an abnormality in the communication between the automatic steering controller 111 and the outboard motor 74 (steps S1 to S3).

In a case where the abnormality detection unit 94 detects an abnormality in the automatic steering controller 111 (step S1: YES), an abnormality in the outboard motor 73 or an abnormality in the outboard motor 74 (step S2: YES), an abnormality in the communication between the automatic steering controller 111 and the outboard motor 73, or an abnormality in the communication between the automatic steering controller 111 and the outboard motor 74 (step S3: YES), the notification request output controller 100 notifies the crew member that an abnormality is detected (step S4).

Subsequently, the automatic steering cancellation unit 96 cancels the control of the outboard motors 73 and 74 by the automatic steering controller 111 (step S5).

Subsequently, the propulsion force gradual reduction controller 97 controls the outboard motor 73 to gradually reduce an opening degree of the throttle valve 11 of the outboard motor 73, until the throttle valve 11 of the outboard motor 73 is fully closed, and simultaneously controls the outboard motor 74 to gradually reduce an opening degree of the throttle valve 11 of the outboard motor 74, until the throttle valve 11 of the outboard motor 74 is fully closed (step S6).

After the throttle valve 11 of the outboard motor 73 and the throttle valve 11 of the outboard motor 74 are fully closed, the propulsion force gradual reduction controller 97 releases the connection between the dog clutch 18 and the forward gear 15 of the outboard motor 73 by controlling the outboard motor 73, and simultaneously releases the connection between the dog clutch 18 and the forward gear 15 of the outboard motor 74 by controlling the outboard motor 74 (step S7).

Subsequently, the notification request output controller 100 requests the crew member to return the positions of the operation lever 77 and the operation lever 78 to the neutral position (step S8).

Subsequently, the operation position determination unit 98 determines whether both the position of the operation lever 77 and the position of the operation lever 78 are the neutral position (step S9). In a case where the crew member returns the positions of the operation lever 77 and the operation lever 78 to the neutral position, the operation position determination unit 98 determines that both the position of the operation lever 77 and the position of the operation lever 78 are the neutral position.

The manual steering start unit 99 maintains the propulsion force of the ship 71 at zero, after the propulsion force of the ship 71 becomes zero under the control of the outboard motors 73 and 74 by the propulsion force gradual reduction controller 97, until the operation position determination unit 98 determines that both the position of the operation lever 77 and the position of the operation lever 78 are the neutral position. After the operation position determination unit 98 determines that both the position of the operation lever 77 and the position of the operation lever 78 are the neutral position (step S9: YES), the manual steering start unit 99 causes the manual steering controller 93 to start the control of the outboard motors 73 and 74. In a case where the automatic steering of the ship 71 ends without any abnormality in the automatic steering operation being detected in steps S1 to S3, the steering mode switching processing ends.

According to the ship steering control device 91 of the second embodiment of the present disclosure, in a case where the automatic steering operation is abnormal, the propulsion forces generated by the outboard motors 73 and 74 are zero and both the position of the operation lever 77 and the position of the operation lever 78 are the neutral position, immediately before the control of the outboard motors 73 and 74 by the manual steering controller 93 is started. That is, immediately before the control of the outboard motors 73 and 74 by the manual steering controller 93 is started when the automatic steering operation is abnormal, the position of the operation lever 77 matches the propulsion force (=zero) generated by the outboard motor 73, and the position of the operation lever 78 matches the propulsion force (=zero) generated by the outboard motor 74. Therefore, in a case where the crew member then operates the operation levers 77 and 78 to start the manual steering of the ship 71, it is possible to prevent the speed of the ship 71 from suddenly changing against the intention of the crew member, and it is possible to prevent the crew member from feeling uncomfortable that the operation of the operation levers 77 and 78 and the movement of the ship 71 do not match.

The present disclosure can also be applied to a ship provided with three or more outboard motors. The present disclosure can also be applied to a ship provided with a remote control device including three or more operation levers. In the embodiments described above, the case where the outboard motor is controlled by the BCM and the ECM has been described as an example, but the method or configuration for controlling the outboard motor is not limited thereto. For example, the outboard motor may be controlled without using the BCM. In the second embodiment described above, the case where orientations of the two outboard motors are respectively controlled by hydraulically controlling the two hydraulic steering actuators has been described as an example, but the two hydraulic steering actuators may be connected with a tie bar, one of the hydraulic steering actuators may be hydraulically controlled, and the other hydraulic steering actuator may be interlocked with the movement of the one hydraulic steering actuator via the tie bar. The steering device that changes a traveling direction of a ship is not limited to a hydraulic actuator, and may be an electric actuator. The present disclosure can also be applied to a ship provided with an outboard motor using an electric motor as a power source that generates a propulsion force. The present disclosure can also be applied to a ship provided with a ship propulsion device other than an outboard motor, such as an inboard-outdrive motor or an inboard motor.

In the embodiments described above, the operation lever of the remote control device is taken as an example of the manual operation unit in the present disclosure, but the manual operation unit in the present disclosure is not limited to the operation lever, and may be, for example, a joystick or a button.

In the embodiments described above, the case where both the steering control and the propulsion force control are automated such that the ship smoothly sails along a route set by the crew member in the automatic steering of the ship has been described as an example, but the present invention is not limited thereto, and only the automation of the propulsion force control may be performed as the automatic steering of the ship.

In the embodiments described above, the case where the abnormality detection unit 44 (94) is configured to detect an abnormality in the automatic steering controller 51 (111), an abnormality in the outboard motor 5 (73, 74), and an abnormality in communication between the automatic steering controller 51 (111) and the outboard motor 5 (73, 74) as an abnormality in the automatic steering operation by the automatic steering controller 51 (111) has been described as an example, but in the present invention, the content of the abnormality in the operation of the automatic steering controller to be detected by the abnormality detection unit is not limited thereto.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A ship steering control device for controlling steering of a ship, the ship including a ship propulsion device configured to generate a propulsion force of the ship and a manual operation unit for manually operating the ship propulsion device, the ship steering control device comprising:

a manual steering controller configured to control the ship propulsion device, according to a manual operation with respect to the manual operation unit;

an automatic steering controller configured to automatically control the ship propulsion device, without receiving the manual operation with respect to the manual operation unit;

an abnormality detection unit configured to detect an abnormality in behavior of the automatic steering controller, wherein the abnormality occurs when a transmission status of communication of signals or information from the automatic steering controller is outside of a predetermined range; and a steering mode switching unit configured to switch control of the ship propulsion device from control by the automatic steering controller to control by the manual steering controller, in a case where the abnormality is detected by the abnormality detection unit when the ship propulsion device is controlled by the automatic steering controller, wherein the manual steering controller is configured to control:

the ship propulsion device such that a propulsion force of the ship becomes zero, in a case where a position of the manual operation unit is a neutral position;

the ship propulsion device such that a propulsion force that pushes the ship forward is generated, in a case where the position of the manual operation unit is moved in one direction from the neutral position; and the ship propulsion device such that the propulsion force that pushes the ship forward increases as a movement amount of the position of the manual operation unit in the one direction from the neutral position increases, and the steering mode switching unit includes:

an automatic steering cancellation unit configured to cancel the control of the ship propulsion device by the automatic steering controller, in a case where the abnormality is detected by the abnormality detection unit;

a propulsion force reduction controller configured to control the ship propulsion device to reduce the propulsion force of the ship until the propulsion force of the ship becomes zero, after the automatic steering cancellation unit cancels the control of the ship propulsion device by the automatic steering controller;

an operation position determination unit configured to determine whether the position of the manual operation unit is the neutral position, after the propulsion force of the ship becomes zero under the control of the ship propulsion device by the propulsion force reduction controller; and a manual steering start unit configured to:

maintain the propulsion force of the ship at zero, after the propulsion force of the ship becomes zero under the control of the ship propulsion device by the propulsion force reduction controller until the operation position determination unit determines that the position of the manual operation unit is the neutral position; and start the control of the ship propulsion device by the manual steering controller, after the operation position determination unit determines that the position of the manual operation unit is the neutral position.

2. The ship steering control device according to claim 1, wherein the automatic steering controller is configured to control the ship propulsion device and configured to change the propulsion force of the ship to cause the ship to travel straight at a constant speed or to smoothly turn the ship.

3. The ship steering control device according to claim 1, wherein the ship propulsion device includes:

an engine;

a throttle device configured to open and close a throttle valve to adjust an inflow amount of combustion air into the engine;

a propeller configured to convert power of the engine into the propulsion force of the ship; and a shift device configured to switch whether or not to transmit the power of the engine to the propeller;

the manual steering controller is configured to:

control the throttle device such that an opening degree of the throttle valve becomes an idling opening degree and control the shift device such that the power of the engine is not transmitted to the propeller, in a case where the position of the manual operation unit is the neutral position,;

control the throttle device such that the opening degree of the throttle valve becomes larger than the idling opening degree and control the shift device such that the power of the engine is transmitted to the propeller, in a case where the position of the manual operation unit is moved in the one direction from the neutral position; and control the throttle device such that the opening degree of the throttle valve increases as the movement amount of the position of the manual operation unit in the one direction from the neutral position increases, the automatic steering controller is configured to control the throttle device to change the opening degree of the throttle valve, in a state where the opening degree of the throttle valve is larger than the idling opening degree and the shift device is switched such that the power of the engine is transmitted to the propeller, and after the automatic steering cancellation unit cancels the control of the ship propulsion device by the automatic steering controller, the propulsion force reduction unit is configured to control the throttle device to reduce the opening degree of the throttle valve until the opening degree of the throttle valve reaches the idling opening degree, and then control the shift device such that the power of the engine is not transmitted to the propeller.

4. The ship steering control device according to claim 1, wherein the abnormality detection unit is configured to detect, as the abnormality in the operation of the automatic steering controller, at least one of an abnormality in the automatic steering controller, an abnormality in the ship propulsion device, and an abnormality in communication between the automatic steering controller and the ship propulsion device.

5. The ship steering control device according to claim 4, wherein the automatic steering controller is configured to transmit abnormality information indicating the abnormality in the automatic steering controller; and the abnormality detection unit is configured to detect the abnormality in the automatic steering controller by receiving the abnormality information.

6. The ship steering control device according to claim 1, wherein the ship includes a plurality of the ship propulsion devices and a plurality of the manual operation units, the plurality of the manual operation units are configured to manually operate the plurality of the ship propulsion devices, the manual steering controller is configured to control the plurality of the ship propulsion devices, according to manual operations with respect to the plurality of the manual operation units, the manual steering controller is configured to control:

the plurality of the ship propulsion devices such that the propulsion force of the ship becomes zero, in a case where positions of all the plurality of the manual operation units are the neutral position;

at least one ship propulsion device among the plurality of the ship propulsion devices such that a propulsion force that pushes the ship forward is generated, in a case where a position of at least one manual operation unit among the plurality of the manual operation units moves in the one direction from the neutral position; and at least one ship propulsion device among the plurality of the ship propulsion devices such that the propulsion force that pushes the ship forward increases as a movement amount of a position of at least one manual operation unit among the plurality of the manual operation units in the one direction from the neutral position increases, the automatic steering controller is configured to automatically control the plurality of the ship propulsion devices, without receiving a manual operation with respect to the manual operation unit among the plurality of manual operation units, the steering mode switching unit is configured to switch control of the plurality of the ship propulsion devices from the control by the automatic steering controller to the control by the manual steering controller, in a case where the abnormality is detected by the abnormality detection unit when the plurality of the ship propulsion devices are controlled by the automatic steering controller, the automatic steering cancellation unit is configured to cancel the control of the plurality of the ship propulsion devices by the automatic steering controller, in a case where the abnormality is detected by the abnormality detection unit, after the automatic steering cancellation unit cancels the control of the plurality of the ship propulsion devices by the automatic steering controller, the propulsion force reduction controller is configured to control the plurality of the ship propulsion devices to reduce the propulsion force of the ship until the propulsion force of the ship becomes zero, the operation position determination unit is configured to determine whether the positions of all the plurality of manual operation units are the neutral position, after the propulsion force of the ship becomes zero under the control of the plurality of the ship propulsion devices by the propulsion force reduction controller, and after the propulsion force of the ship becomes zero under the control of the plurality of the ship propulsion devices by the propulsion force reduction controller, the manual steering start unit is configured to:

maintain the propulsion force of the ship at zero until the operation position determination unit determines that the positions of all the plurality of manual operation units are the neutral position; and start the control of the plurality of the ship propulsion devices by the manual steering controller, after the operation position determination unit determines that the positions of all the plurality of manual operation units are the neutral position.

7. A ship steering control device for controlling steering of a ship, the ship including a ship propulsion device configured to generate a propulsion force of the ship and a manual operation unit for manually operating the ship propulsion device, the ship steering control device comprising: a manual steering controller configured to control the ship propulsion device, according to a manual operation with respect to the manual operation unit;

an automatic steering controller configured to automatically control the ship propulsion device, without receiving the manual operation with respect to the manual operation unit; and a controller configured to:

detect an abnormality in behavior of the automatic steering controller, wherein the abnormality occurs when a transmission status of communication of signals or information from the automatic steering controller is outside of a predetermined range; and switch control of the ship propulsion device from control by the automatic steering controller to control by the manual steering controller, in a case where the abnormality is detected by the controller when the ship propulsion device is controlled by the automatic steering controller, wherein the manual steering controller is configured to control:

the ship propulsion device such that a propulsion force of the ship becomes zero, in a case where a position of the manual operation unit is a neutral position;

the ship propulsion device such that a propulsion force that pushes the ship forward is generated, in a case where the position of the manual operation unit is moved in one direction from the neutral position; and the ship propulsion device such that the propulsion force that pushes the ship forward increases as a movement amount of the position of the manual operation unit in the one direction from the neutral position increases, and the controller is further configured to:

cancel the control of the ship propulsion device by the automatic steering controller, in a case where the abnormality is detected by the controller;

control the ship propulsion device to reduce the propulsion force of the ship until the propulsion force of the ship becomes zero, after the controller cancels the control of the ship propulsion device by the automatic steering controller;

determine whether the position of the manual operation unit is the neutral position, after the propulsion force of the ship becomes zero under the control of the ship propulsion device; and maintain the propulsion force of the ship at zero, after the propulsion force of the ship becomes zero under the control of the ship propulsion device until the controller determines that the position of the manual operation unit is the neutral position; and start the control of the ship propulsion device by the manual steering controller, after the controller determines that the position of the manual operation unit is the neutral position.

* * * * *